US010968692B2

(12) United States Patent
Marocco

(10) Patent No.: US 10,968,692 B2
(45) **Date of Patent: *Apr. 6, 2021**

(54) ENCLOSED BLIND CONTROL

(71) Applicant: MAXXMAR INC., Toronto (CA)

(72) Inventor: Norbert Marocco, Toronto (CA)

(73) Assignee: MAXXMAR INC., Toronto (CA)

( * ) Notice: Subject to any disclaimer, the term of this patent is extended or adjusted under 35 U.S.C. 154(b) by 242 days.

This patent is subject to a terminal disclaimer.

(21) Appl. No.: 16/005,247

(22) Filed: Jun. 11, 2018

(65) Prior Publication Data

US 2018/0291680 A1 Oct. 11, 2018

Related U.S. Application Data

(62) Division of application No. 15/447,955, filed on Mar. 2, 2017, now Pat. No. 10,208,535.

(51) Int. Cl.

| | |
|---|---|
| ***E06B 9/322*** | (2006.01) |
| ***E06B 9/326*** | (2006.01) |
| ***E06B 9/78*** | (2006.01) |

(52) U.S. Cl.

CPC ..... *E06B 9/322* (2013.01); *E06B 9/326* (2013.01); *E06B 9/78* (2013.01); *E06B 2009/785* (2013.01)

(58) Field of Classification Search

CPC . E06B 9/322; E06B 9/326; E06B 9/78; E06B 9/76; E06B 2009/785; E06B 2009/3265

USPC ..... 160/321, 909

See application file for complete search history.

(56) References Cited

U.S. PATENT DOCUMENTS

| | | | | | |
|---|---|---|---|---|---|
| 537,351 | A * | 4/1895 | Neuenschwander | E06B 9/52 | 160/88 |
| 1,547,015 | A * | 7/1925 | Batya | E06B 9/76 | 160/309 |
| 2,059,134 | A * | 10/1936 | Metcalf | E06B 9/305 | 160/115 |
| 2,116,357 | A * | 5/1938 | Laborda | E06B 9/306 | 160/168.1 R |
| 3,022,819 | A * | 2/1962 | Lampret | A47H 5/032 | 160/345 |
| 3,123,130 | A * | 3/1964 | Fridlund | E06B 9/322 | 160/168.1 R |
| 3,123,182 | A * | 3/1964 | Malone et al. | A47H 5/032 | 188/65.1 |
| 4,481,998 | A * | 11/1984 | Strandberg | A47H 5/0325 | 160/126 |
| 4,685,502 | A * | 8/1987 | Spangenberg | E06B 9/264 | 160/107 |

(Continued)

FOREIGN PATENT DOCUMENTS

| | | | | |
|---|---|---|---|---|
| EP | 2458128 A1 * | 5/2012 | ..... | E06B 9/78 |
| GB | 2511561 A * | 9/2014 | ..... | E06B 9/326 |

(Continued)

*Primary Examiner* — Johnnie A. Shablack

(74) *Attorney, Agent, or Firm* — Eugene J. A. Gierczak; Miller Thomson LLP

(57) ABSTRACT

A blind having a blind operating mechanism and a blind control element and having an enclosure for the blind control element, with the element completely enclosed, a connector supporting the enclosure on the blind, and depending downwardly, and a drive device at the lower end of the enclosure for operating the element.

22 Claims, 22 Drawing Sheets

(56) References Cited

U.S. PATENT DOCUMENTS 4,813,469 A * 3/1989 Scott ..... E06B 9/326 160/178.2
4,865,109 A * 9/1989 Sherman ..... E06B 9/78 160/321
4,932,456 A * 6/1990 Buxbaum ..... E06B 9/324 160/300
5,125,447 A * 6/1992 Suggs ..... A47H 5/032 160/320
5,465,775 A * 11/1995 Biba ..... E06B 9/306 160/168.1 R
5,465,779 A * 11/1995 Rozon ..... E06B 9/326 160/168.1 V
5,513,687 A * 5/1996 Tuzmen ..... E06B 9/326 160/168.1 R
5,671,793 A * 9/1997 Lee ..... E06B 9/307 160/168.1 R
5,676,188 A * 10/1997 Cadorette ..... E06B 9/326 160/320
5,752,558 A * 5/1998 Lin ..... E06B 9/326 16/219
5,797,441 A * 8/1998 Benthin ..... E06B 9/361 160/173 V
5,845,696 A * 12/1998 Chou ..... E06B 9/36 160/178.1 V
6,085,824 A * 7/2000 Cadorette ..... E06B 9/326 160/177 V
6,196,293 B1 * 3/2001 Lee ..... E06B 9/303 160/168.1 V
6,463,987 B1 * 10/2002 Nevins ..... E06B 9/32 160/173 R
6,516,860 B1 * 2/2003 Weaver ..... E06B 9/30 160/168.1 R
6,792,995 B2 * 9/2004 Judkins ..... E06B 9/326 160/173 R
7,114,544 B2 * 10/2006 Rice ..... E06B 9/322 160/178.1 V
7,353,857 B2 * 4/2008 Koop ..... E06B 9/324 160/178.1 R
8,091,606 B2 * 1/2012 Nien ..... E06B 9/322 15/144.1
8,286,686 B2 * 10/2012 Cannaverde ..... E06B 9/326 160/178.1 R
8,302,653 B2 * 11/2012 O'Hair ..... E06B 9/327 160/172 R
8,499,814 B2 * 8/2013 Ng ..... E06B 9/324 160/168.1 R
8,539,645 B2 * 9/2013 Marocco ..... A47H 3/08 160/178.1 R
8,544,525 B2 * 10/2013 Zhu ..... E06B 9/326 160/321
8,662,136 B2 * 3/2014 Nevins ..... F16G 11/00 160/173 R
8,763,671 B2 * 7/2014 Vestal ..... E06B 9/262 160/84.01
8,763,675 B2 * 7/2014 Zhu ..... E06B 9/32 160/321
8,931,538 B2 * 1/2015 Ho ..... E06B 9/326 160/168.1 R
8,950,463 B2 * 2/2015 Vestal ..... E06B 9/262 160/168.1 R
8,967,226 B2 * 3/2015 Vestal ..... E06B 9/262 160/321
9,016,347 B2 * 4/2015 Lin ..... E06B 9/326 160/321
9,038,696 B2 * 5/2015 Lava ..... E06B 9/326 160/321
9,212,518 B2 * 12/2015 Mann ..... E06B 9/324
9,506,290 B2 * 11/2016 Lin ..... E06B 9/76
10,017,984 B2 * 7/2018 Marzilli ..... E06B 9/50
10,208,535 B2 * 2/2019 Marocco ..... E06B 9/326
2004/0003900 A1 * 1/2004 Nien ..... E06B 9/32 160/168.1 R
2011/0094065 A1 * 4/2011 Frederick ..... E06B 9/326 24/115 F
2012/0097343 A1 * 4/2012 O'Hair ..... E06B 9/322 160/168.1 R
2012/0160431 A1 * 6/2012 Cannaverde ..... E06B 9/326 160/340
2012/0279021 A1 * 11/2012 Marocco ..... A47H 3/08 24/136 K
2012/0285635 A1 * 11/2012 Zhu ..... E06B 9/32 160/340
2013/0068405 A1 * 3/2013 Lava ..... E06B 9/326 160/321
2013/0091968 A1 * 4/2013 Lin ..... E06B 9/76 74/89.21
2015/0007674 A1 * 1/2015 Gramsch ..... E06B 9/326 74/89.2
2015/0252615 A1 * 9/2015 Lava ..... E06B 9/326 160/321
2015/0275576 A1 * 10/2015 Lava ..... E06B 9/326 160/321
2018/0238109 A1 * 8/2018 Kanargelidis ..... E06B 9/42
2018/0291680 A1 * 10/2018 Marocco ..... E06B 9/78
2019/0093427 A1 * 3/2019 Marocco ..... E06B 9/78
2019/0169929 A1 * 6/2019 Zhang ..... E06B 9/78
2019/0195014 A1 * 6/2019 Chua ..... E06B 9/78
2019/0390513 A1 * 12/2019 Marocco ..... E06B 9/78
2019/0390514 A1 * 12/2019 Marocco ..... E06B 9/42

FOREIGN PATENT DOCUMENTS

GB 2526372 A * 11/2015 ..... E06B 9/326
WO WO-2013015643 A9 * 6/2013 ..... E06B 9/326
WO WO-2015026142 A1 * 2/2015 ..... E06B 9/42
WO WO-2015172754 A1 * 11/2015 ..... E06B 9/324

* cited by examiner

ENCLOSED BLIND CONTROL

This application is a divisional of U.S. application Ser. No. 15/447,955 filed Mar. 2, 2017.

FIELD OF THE INVENTION

This application is based on U.S. provisional application Ser. No. 62/430,685 title Enclosed Blind Control inventor Norbert Marocco filed Dec. 6, 2016, the priority of which is claimed.

The invention relates to a blind having a blind control element and an enclosure for the blind control element preventing unsafe, or unwanted access to the blind control element, and providing a means for operating the blind control element

BACKGROUND OF THE INVENTION

Blinds for building openings, eg windows, doors and the like, may be operated either simply down and up, in the case of eg. roller blinds, or in the case of eg. vertical shade panels, the vertical shade panels may be rotated open or closed.

The control elements for these blind operations are usually in the form of an endless cord or chain. The control element simply hangs down along one side of the building opening, in an endless loop.

Other forms of blinds and window coverings may also be operated by means of an endless control element hanging in a loop.

In the past this system has been widely used, and experience was believed to be mainly satisfactory. In some cases a pendant weight was located on the loop, to assist in controlling it.

U.S. Pat. No. 4,932,456, inventor G Buxbaum, shows the usual form of blind chain and drive sprocket gear on the blind roller such as being standard in the art.

However safety considerations for some time have been forcing Government agencies seek further ways to restrict unsafe or unwanted access to the endless loop type of control element. The intent of these considerations has been mainly to prevent any chance that the element, may possibly create a hazard to children, or handicapped persons, or even pets.

In addition, by guiding and controlling the loop of the element, its operation by anyone becomes somewhat easier. The element is prevented from becoming twisted, or entangled with any other blinds controls, curtains or the like.

A simple pulley, fixed to the building fabric, and holding the loop in tension, was proposed to achieve this result. However such a pulley may become dislodged or loosened from the building to which it was attached. The guide pulley will then hang loose on the loop of the element, leaving the element uncontrolled, as before.

This led to accidents and unsafe conditions.

In other cases the pulley might have been installed incorrectly.

In U.S. Pat. No. 8,539,645 Inventor Mario M Marocco, there is shown a form of lock for a blind cord loop control in which a spring operated lock is used.

One of the problems in simply attaching the lower end of the loop to a pulley, is that the pulley, in whatever form it took, was attached to the window frame.

This meant that the customer who wished to adjust the blind had to stand close to the window to reach the chain. This may have been an inconvenience to many.

To prevent unsafe conditions and accidents it is new proposed that the element will be enclosed, blocked or shielded. Also, while rendering the system safe, preferably, the entire control system should not be actually anchored at its lower end to the window frame.

It should be at least be somewhat moveable so that a customer could reach for the control without having to actually stand alongside the window.

U.S. Pat. No. 9,038,696, Aaron Lava, issued May 2015, shows a form of a rigid wand, holding the chain in tension, but otherwise the chain is fully exposed outside of the elongate or wand.

Adjustment of the chain was performed manually by simply grasping the chain exposed on one side or the other of the wand. This proposal still does not meet the problem of safety. Children, or even pets, could easily reach the chain exposed on each side of the wand.

A generally similar proposal is shown in U.S. Pat. No. 8,967,226, W D Vesta, issued Mar. 3, 2015. This proposal describes a rigid wand with pulleys top and bottom. The chain is substantially exposed along each side of the wand. It would not satisfy the requirements for safely.

Other arrangements are shown in U.S. Pat. Nos. 3,022,819, 5,752,558, 4,865,109, 6,192,293, 5,797,441, 5,845,696 and 4,865,109

BRIEF SUMMARY OF THE INVENTION

With a view to providing a more effective, and aesthetically appealing solution to these problems, the invention provides a blind operated by at least one flexible blind control element, and a driven sprocket connected to the blind and having a safety enclosure for the blind control element, in which the element is enclosed, blocked or shielded, a support for the upper end of the enclosure allowing it to depend downwardly alongside the blind, and a drive system on the lower end of the enclosure operable to move the element within the enclosure and thus drive the driven sprocket.

Preferably the invention provides a blind operated by at least one safety blind control element, in which the enclosure is in the form of a tube with the element running inside the tube.

The invention also provides a blind operated by at least safety blind control element in which the enclosure consists of a channel and a separate closure for the channel.

Preferably the invention provides a blind operated by at least one safety blind control element and in which the drive system is a rotary driver such as a spool or sprocket with a handle or other drive means by which the rotary driver can be rotated, and in which the handle can be placed on one or other of the opposite sides of the drum.

Alternatively there may be simple holes or recesses in the driver to permit it to be moved by the fingers, or a simple tool such as a pencil, for example, or even some form of motorised drive such as an electric motor.

Preferably the invention provides a blind operated by at least one safety blind control element and in which the enclosure is attached to the blind by a flexible support, enabling the enclosure to be swung away from the blind, for access.

The enclosure can also be attached to the window or building, if that is preferred, or even simply left free to hang from the blind itself, or the element.

Preferably the invention provides a blind operated by at least one safety blind control element which is formed with element guides at its upper and lower ends.

There may be a separate winding handle for the rotary driver. The handle may be attached to one side or to the other, and may have an extension extending radially out to provide greater mechanical advantage.

It is also possible to provide a small drive motor, operated by a battery, so that moving the safety blind control element can be done at the push of a button, or even by means of a remote.

The drive motor can be a small hand held appliance with a simple rotary drive head, eg a square or other shaft. The rotary driver can have a sleeve or socket designed to receive the drive head of the motor. In this way the one motor drive can be used to operate several different blinds.

In one embodiment the enclosure for the element can consist of channels for receiving the two lengths of the element loop. The two channels can be open, along either side of the enclosure so as to shield, block or bar access to the endless loop blind control element. This can enable the homeowner to grasp the element itself, to adjust the blind, instead of using the rotary driver at the lower end of the enclosure.

The enclosure may also be spring loaded, so as to apply continuous tension to the element loop, while allowing part of the element to be manipulated.

The invention also provides for a homeowner seeking to update existing old technology blinds, the facility to buy components and retrofit them to an existing blind.

It is another aspect of this invention to provide a safety device for an endless loop blind control element operating a blind operating mechanism comprising: an enclosure for the endless loop blind control element, the enclosure having at least one channel for receiving and inhibiting access to the endless loop blind control element; biasing structure such as springs disposed in the enclosure for urging opposite ends of the endless loop blind control element away from each other; and a drive device carried by the enclosure for connecting the endless loop blind control element to the blind operating mechanism.

In another embodiment the safety device includes at least one channel disposed on an external surface of the enclosure for receiving and inhibiting access to a portion of the endless loop blind control element.

In another embodiment the safety device includes a pair of spaced channels disposed on the external surface of the enclosure, each channel receiving and inhibiting access to a portion of the endless loop blind control element respective.

Also the enclosure of the safety device has a first end and a second end wherein the first end is pivotally connected to the operating mechanism for movement of the enclosure relative the operating mechanism about a first axis. In another preferred embodiment the first end is pivotally connected to the operating mechanism for movement of the enclosure relative the operating mechanism about a second axis substantially perpendicular to the first axis.

The various features of novelty which characterizes the invention are pointed out with more particularity in the claims annexed to and forming a part of this disclosure.

For a better understanding of the invention, its operating advantages and specific objects attained by its use, reference should be made to the accompanying drawings and descriptive matter in which there are illustrated and described preferred embodiments of the invention.

IN THE DRAWINGS

Figure 9A:
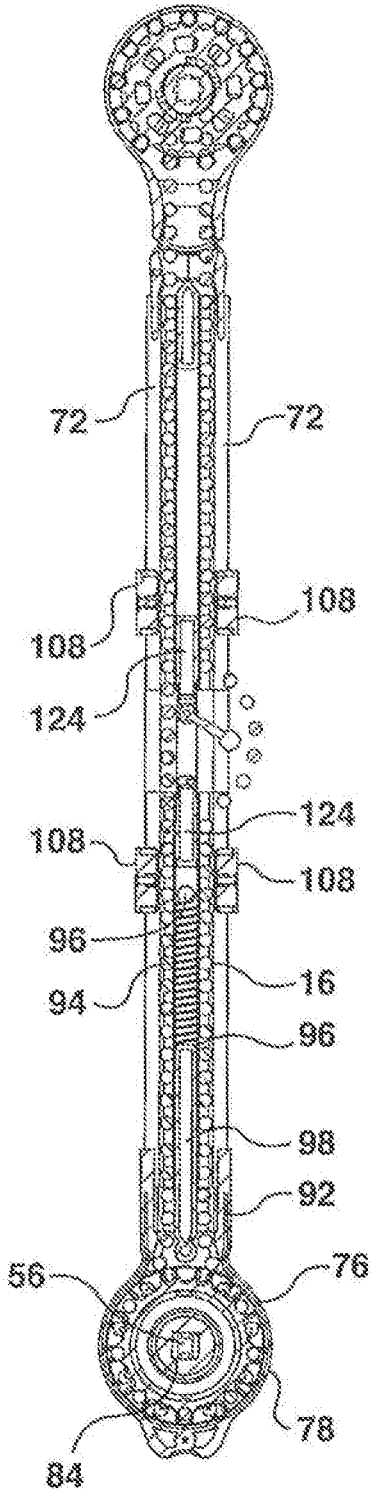
Figure 9B:
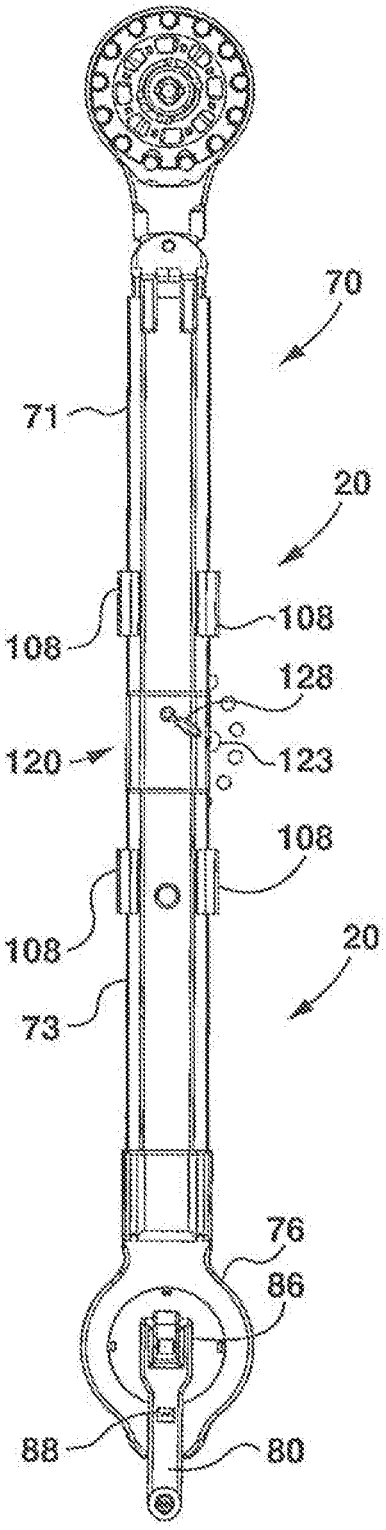
Figure 9C:
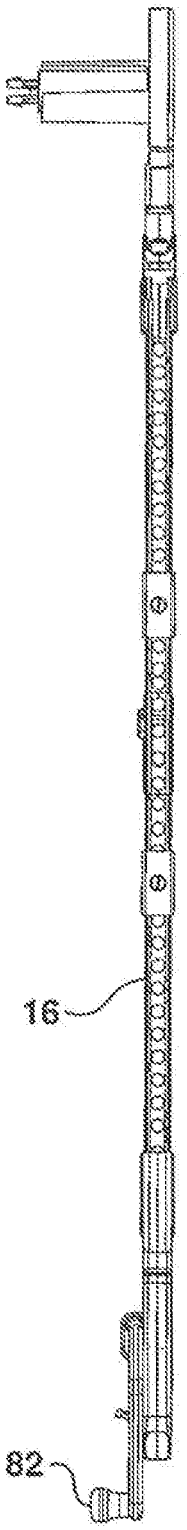
Figure 10:
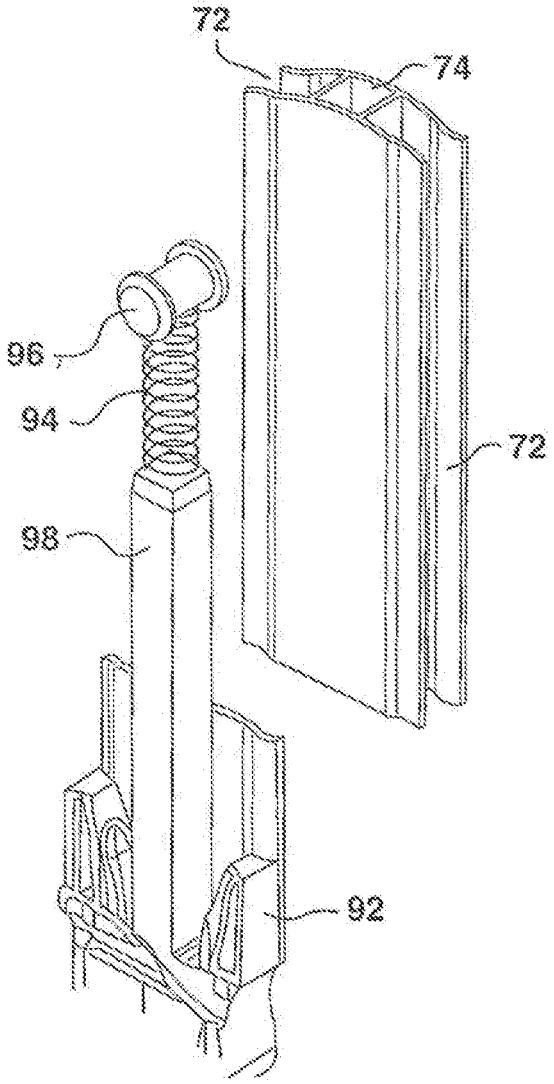

FIGS. 8*a*, 8*b*, 8*c*, 8*d*, 8*e*, 8*f* illustrate another embodiment;

FIG. 9*a*, 9*b*, 9*c*, illustrate yet another embodiment;

FIG. 10 is a perspective of a portion of the wand of FIGS. 9*a*, 9*b*, 9*c;*

Figure 11:
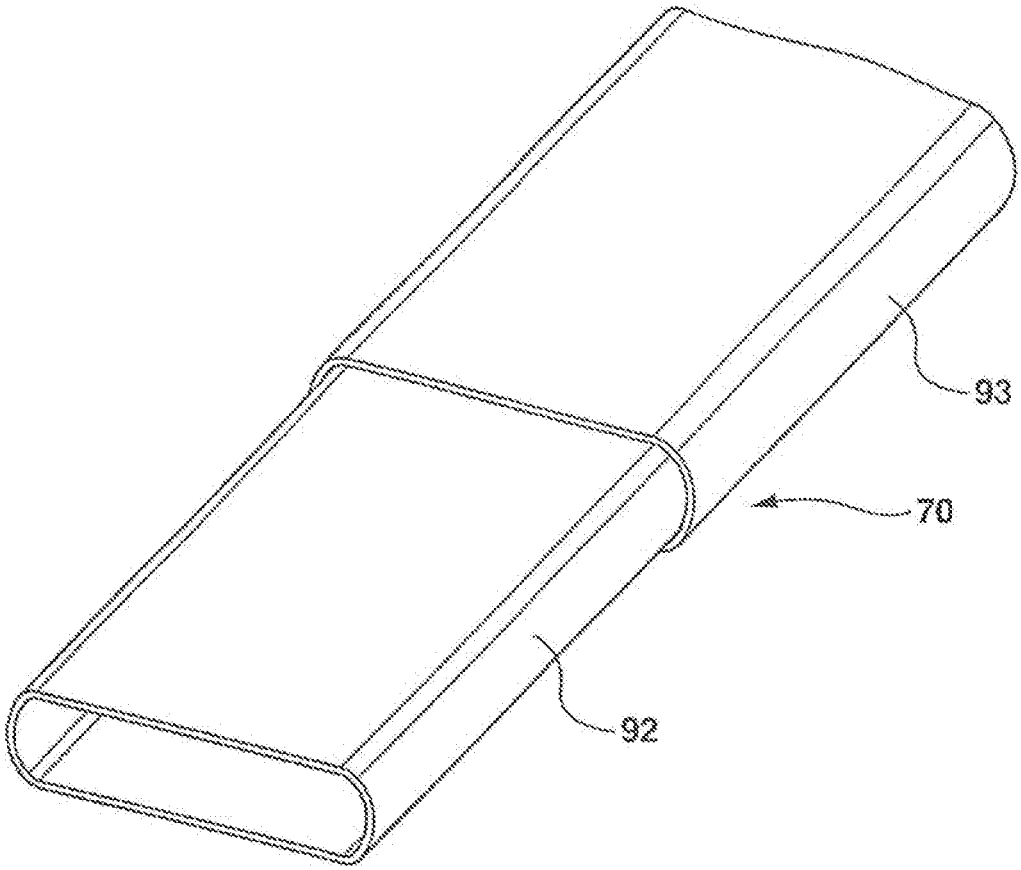

FIG. 11 is a cut away perspective of a telescopic form of enclosure

Figure 12:
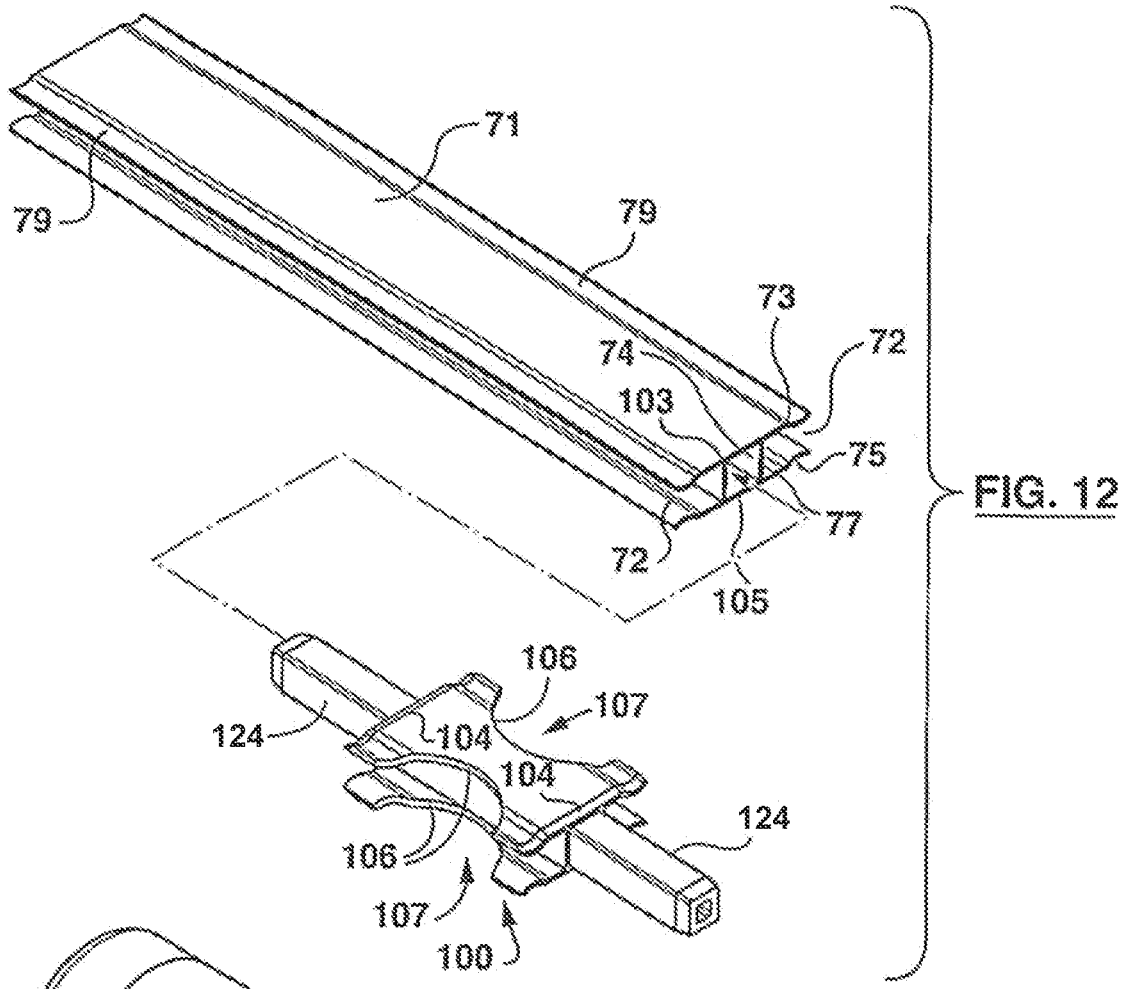

FIG. 12 is an exploded perspective of the joint feature of FIGS. 8*a*, 8*b*, 8*c*, 8*d*, 8*f;*

Figure 13:
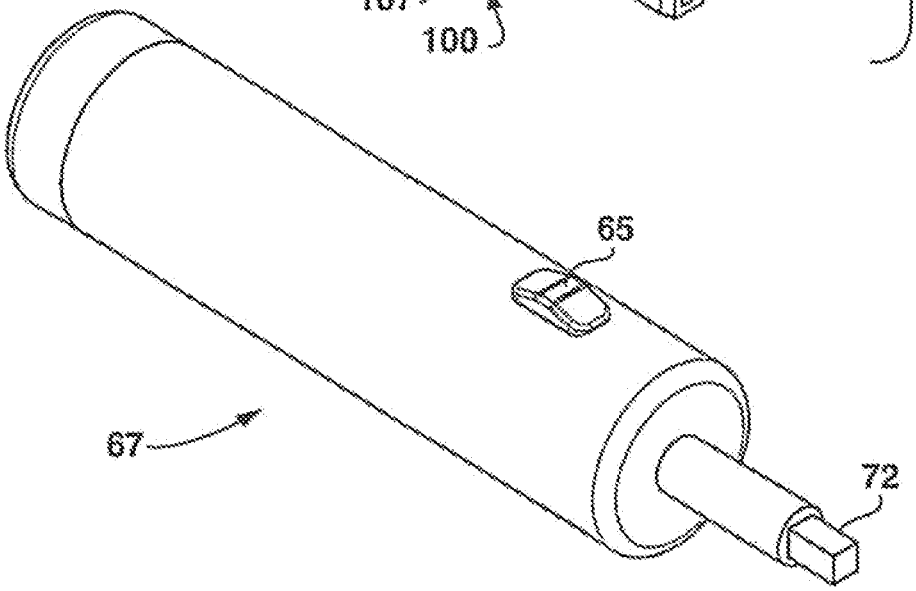
Figure 14:
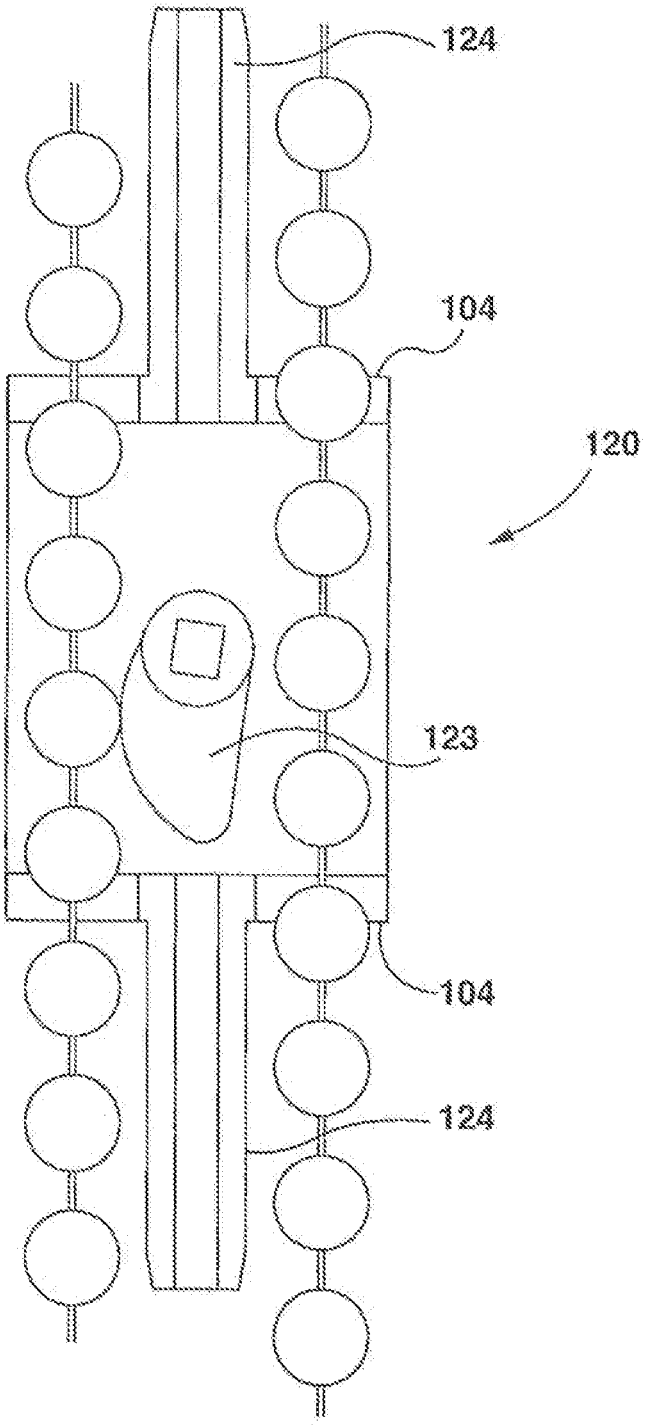
Figure 15:
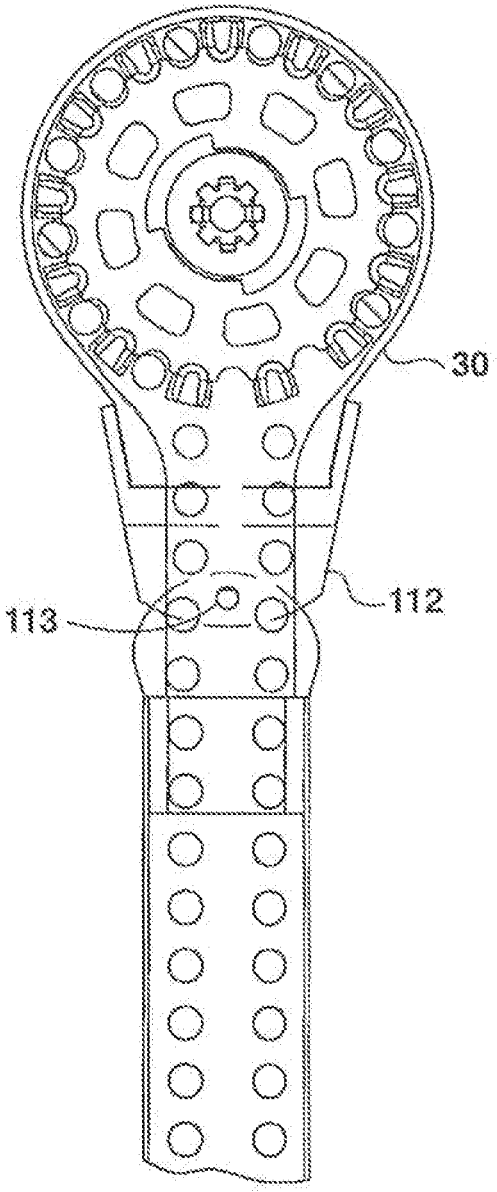
Figure 16:
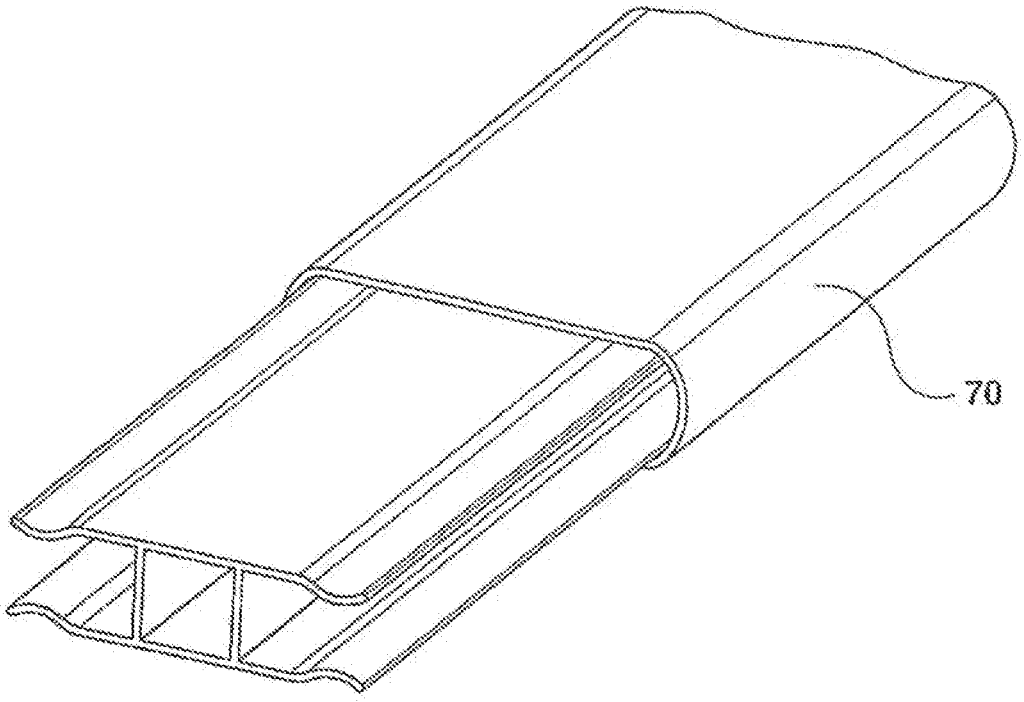
Figure 17:
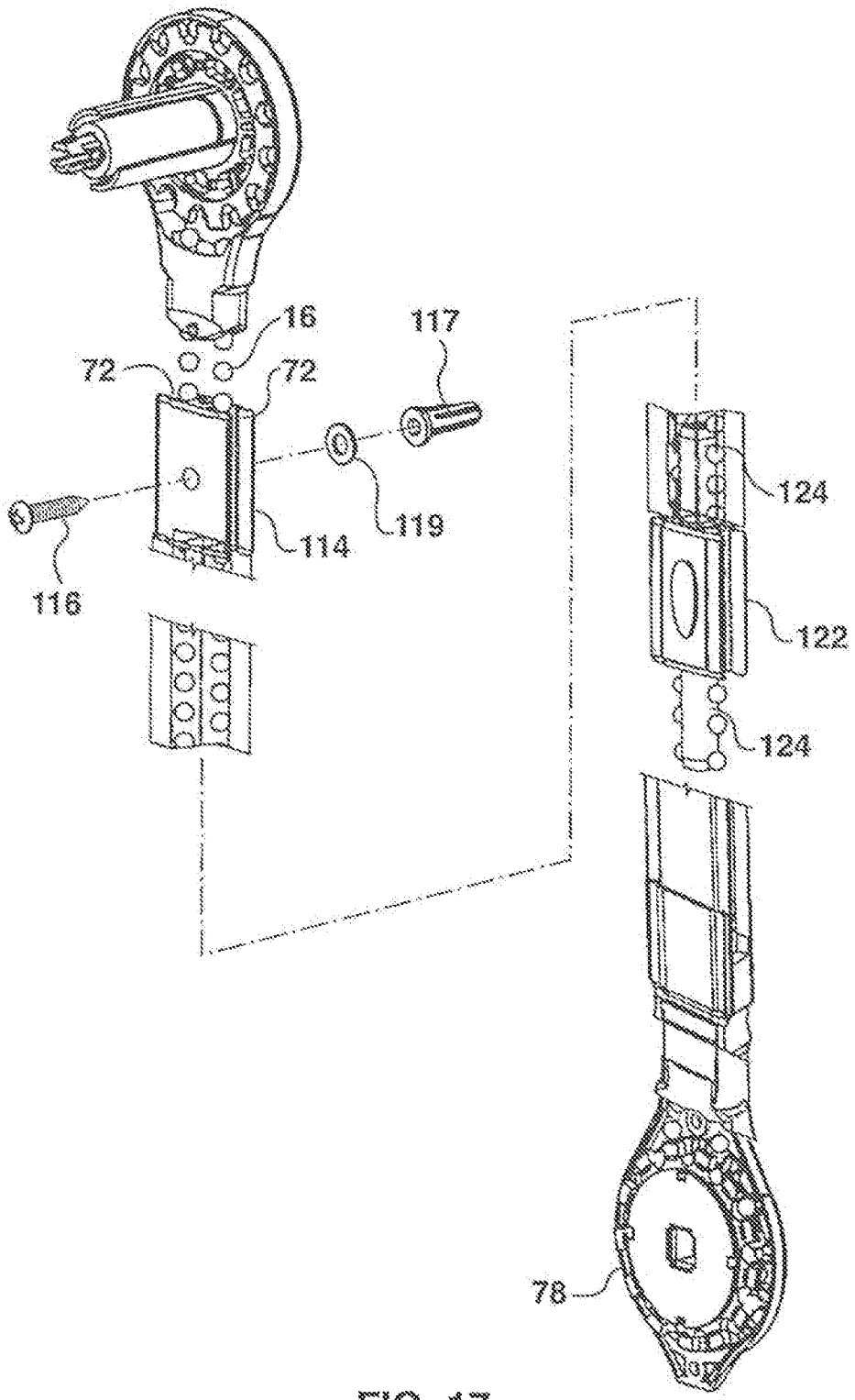
Figure 18:
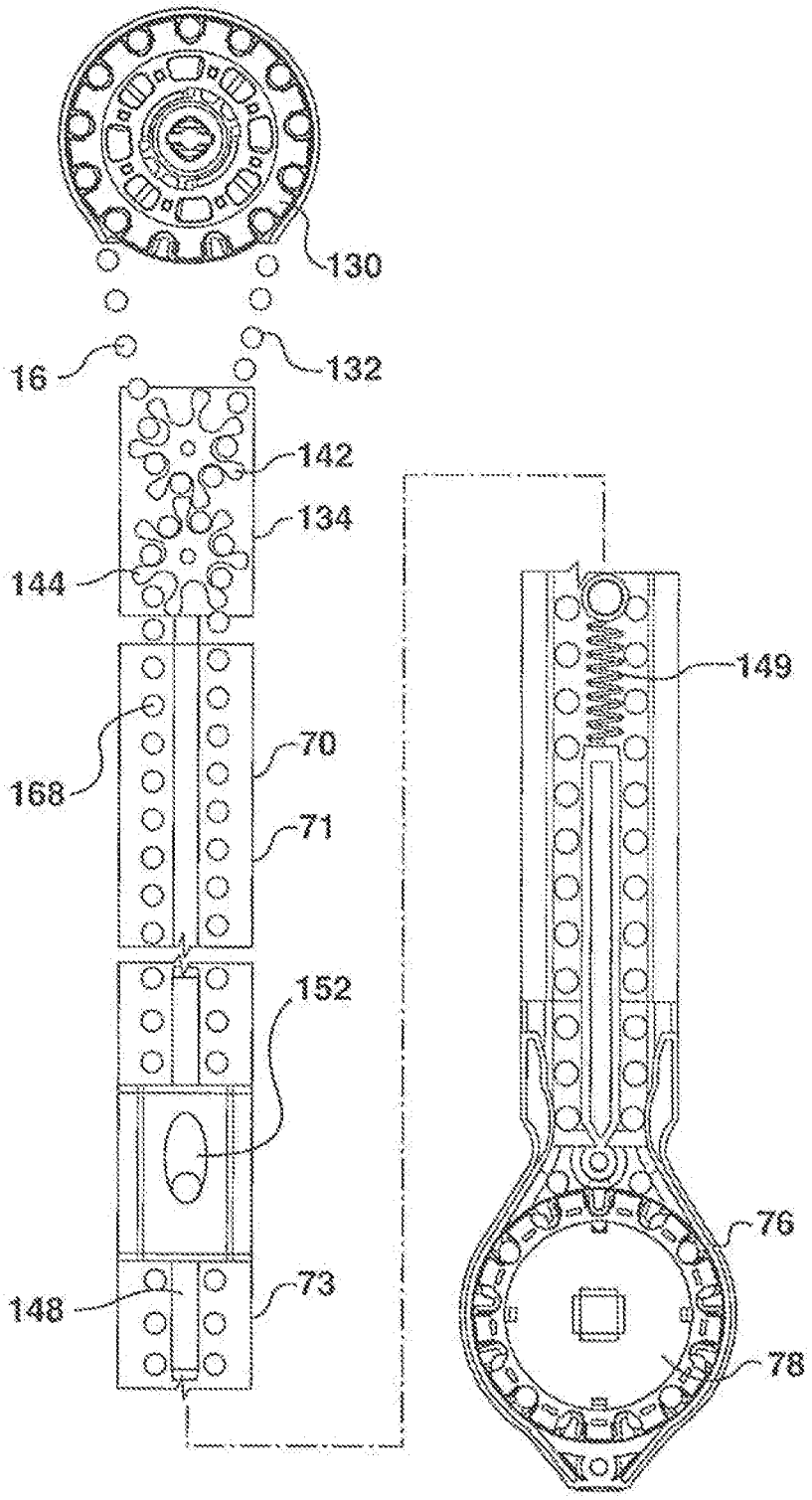
Figure 19:
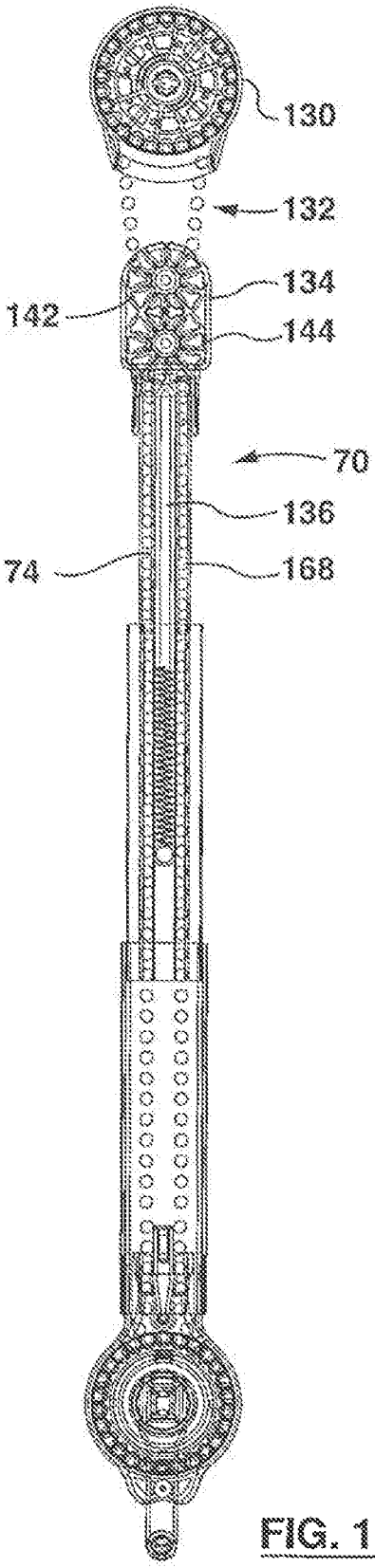
Figure 20A:
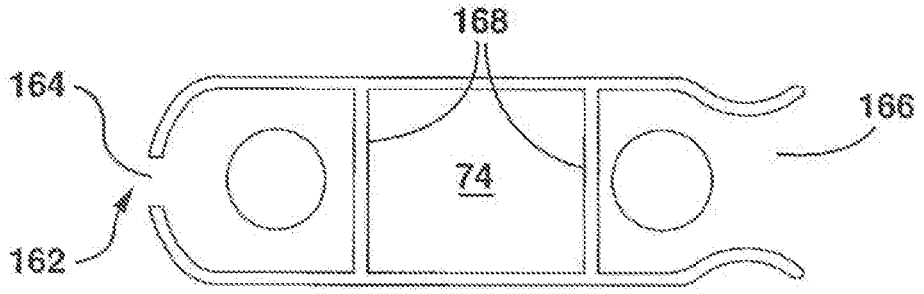
Figure 20B:
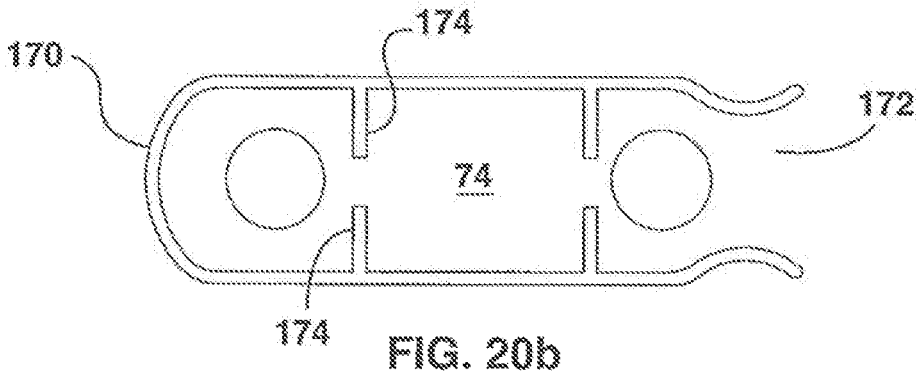
Figure 20C:
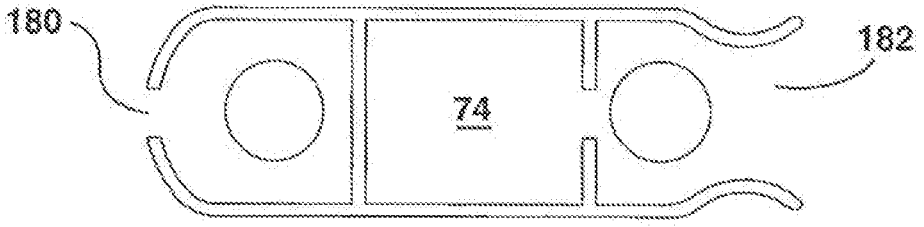
Figure 20D:
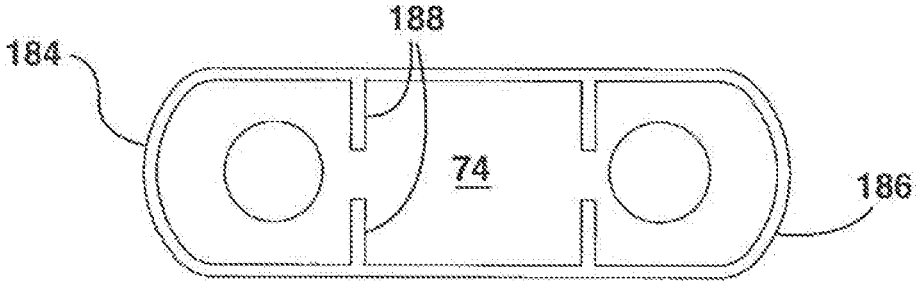
Figure 21:
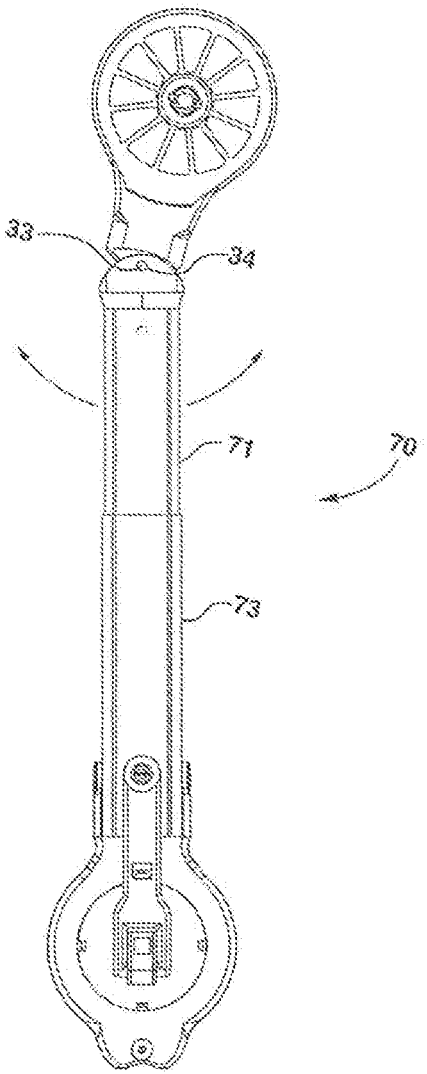
Figure 22:
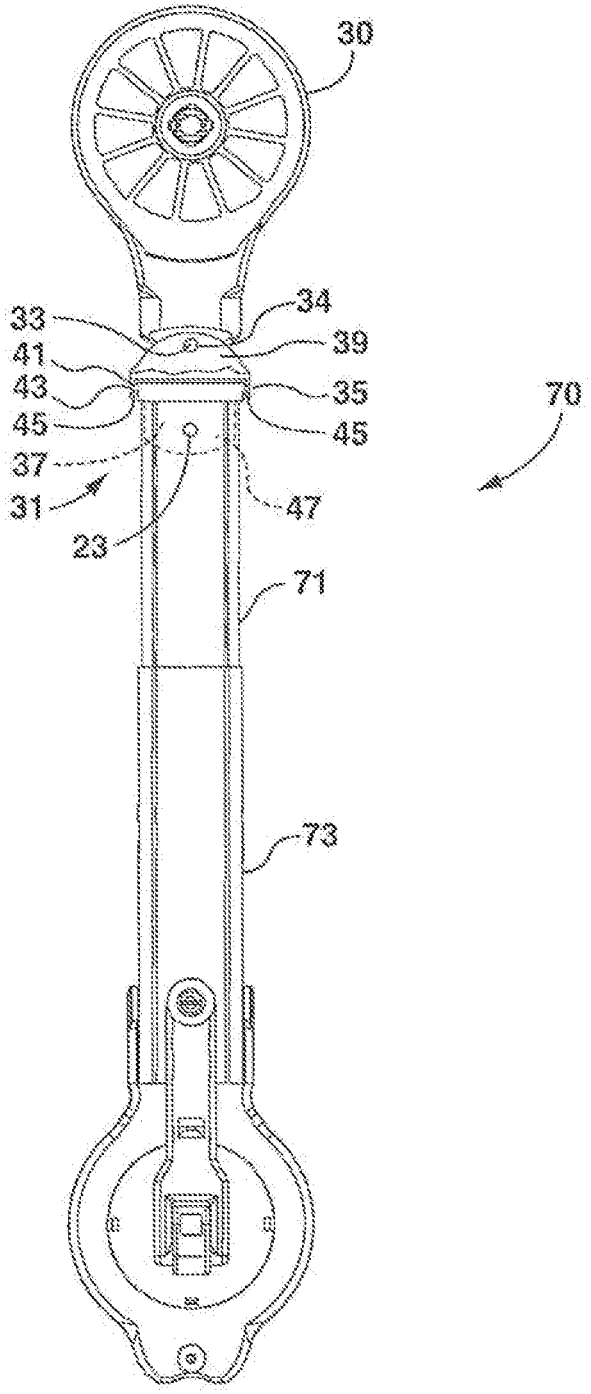
Figure 23:
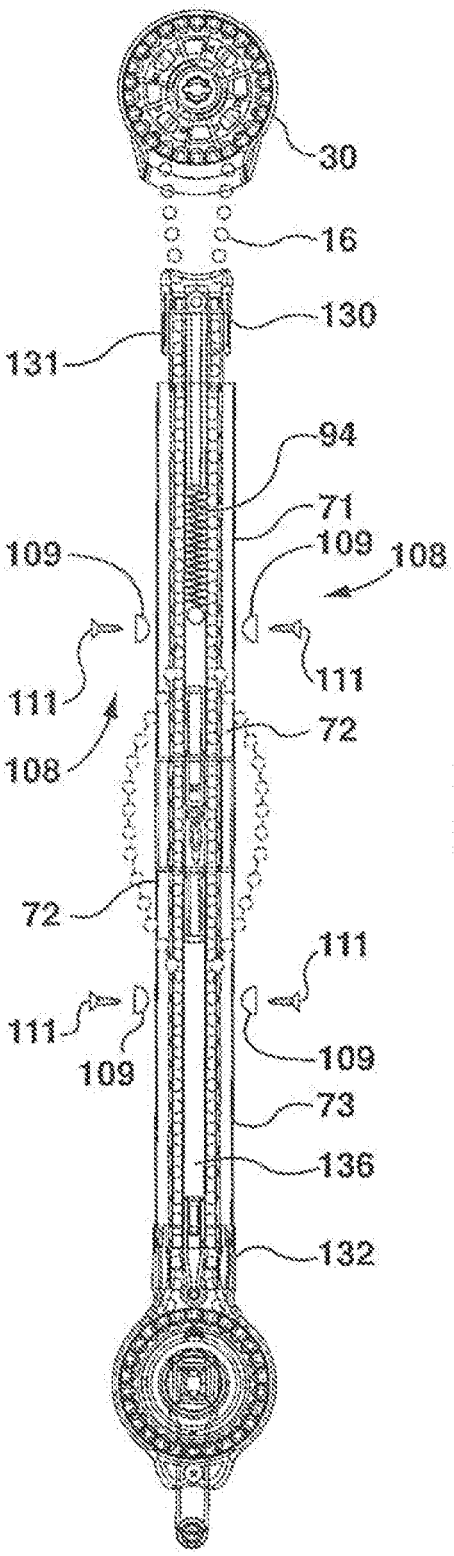
Figure 24:
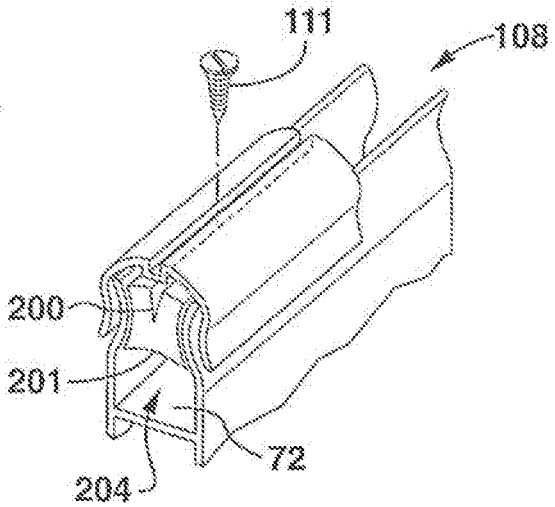
Figure 25:
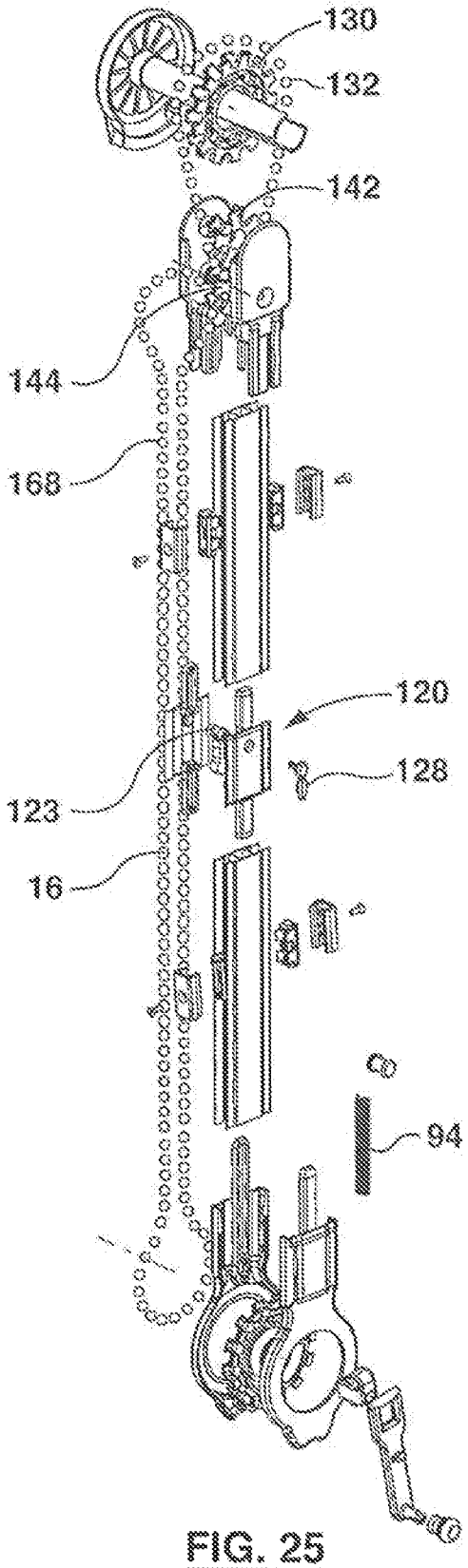

FIG. 13 is a perspective of an electric powered hand tool for the blind control;

FIG. 14 is a section of an alternate embodiment of connector body showing a cam member;

FIG. 15 is a schematic view in plan of an alternate embodiment;

FIG. 16 is a cut away perspective of an alternate embodiment of a telescopic form of enclosure;

FIG. 17 is a cut away perspective of another embodiment;

FIG. 18 is an exploded plan view of another embodiment with a spring disposed near the bottom end;

FIG. 19 is a cut away perspective of another embodiment with a spring disposed near the middle;

FIG. 20*a*, 20*b*, 20*c*, 20*d*, are sections of a further embodiments showing a wand enclosure FIG. 21 shoes a further embodiment of the enclosure pivoting about an axis;

FIG. 22 shows a further embodiment of the enclosure pivoting about a first and second axis;

FIG. 23 is a partial exploded view of another embodiment showing slideable stoppers;

FIG. 24 shows an embodiment of the sildeable stoppers;

FIG. 25 is an exploded view of another embodiment of the invention.

Figure 26:
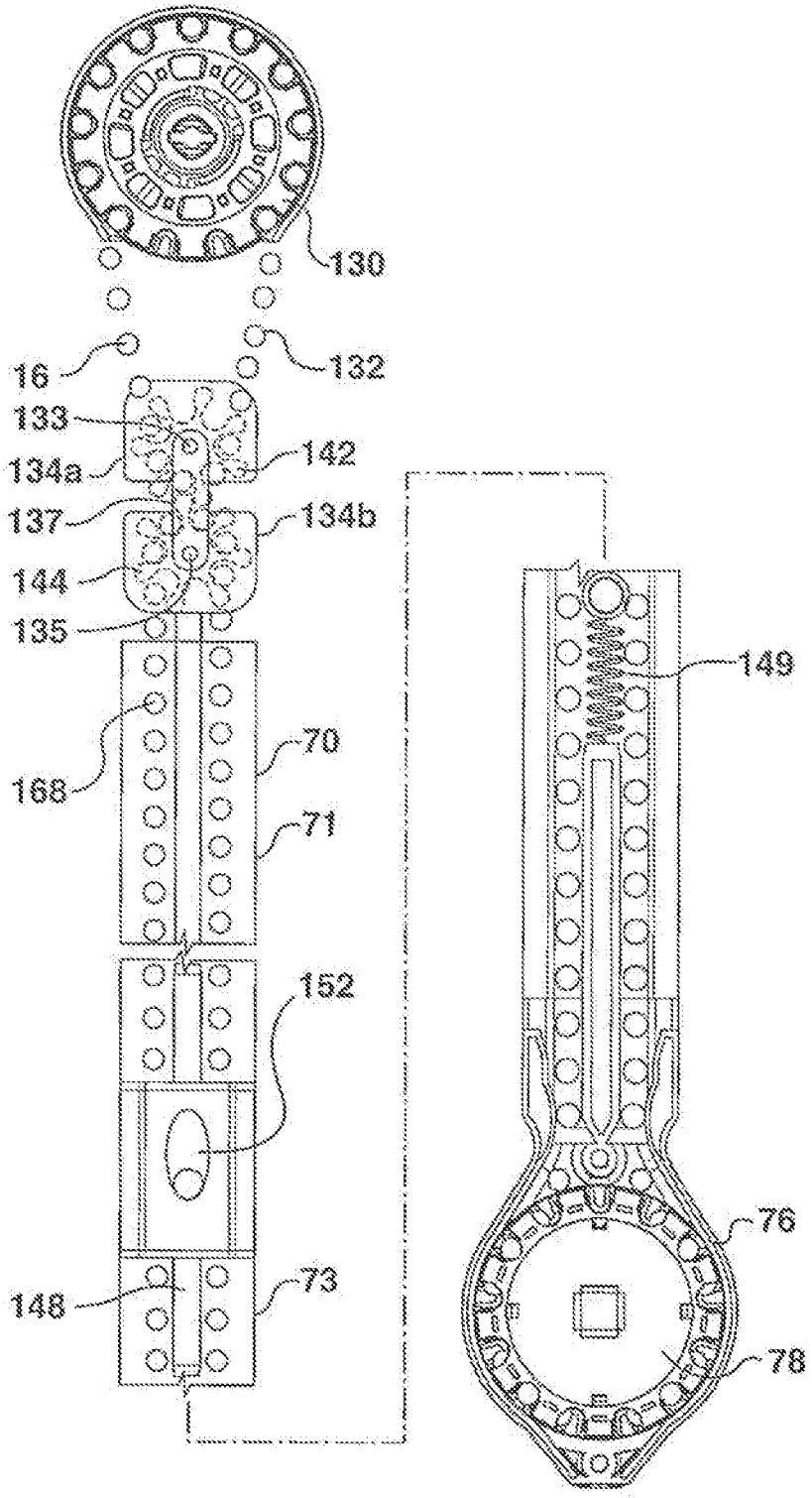

FIG. 26 is a view showing two spaced gear boxes joined together by a link.

DETAILED DESCRIPTION OF THE INVENTION

Figure 1:
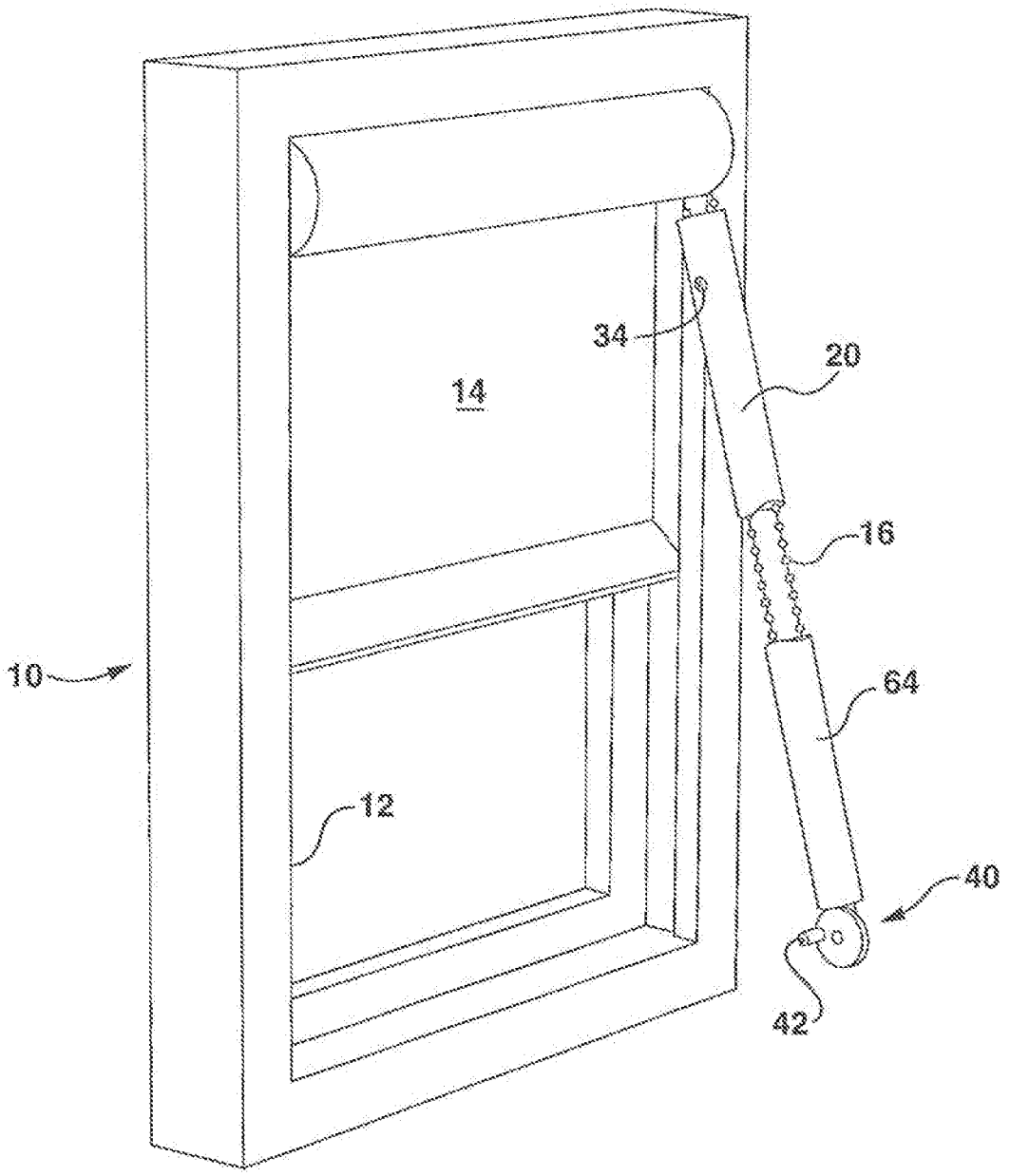
FIG. 1 is a perspective of a typical window with a simple roller blind installed with a safety blind control element, and illustrating the blind control element enclosure with a cut out view showing with safety blind control element.

Referring first to FIG. 1, it will be seen that a simple window, 10 representing a building opening, has a typical border frame 12. A simple roller blind 14 is shown mounted on the frame. The blind, in this example, is a sheet of suitable material wound onto a roller, from which the sheet or blind may be lowered and raised. The roller is operated, in this case, by a safety blind control element 16. The element in this example is shown as the typical chain type of element, with a series of balls 18 connected by wire or other filament material in an endless chain. This element runs around a well known form of sprocket gear drive (not shown) in the mechanism of the blind 14.

There will usually be some form of clutch (not shown) associated with the blind. This purpose is to prevent the blind from unwinding on its own.

Such features are very well known in the industry and require no illustration.

As is usual the element 16 is an endless loop. Pulling one side of the loop will lower the blind and pulling the other side of the loop will raise it.

The roller blind shown is merely by way of example. Various forms of blind employ the continuous loop type of blind control element. The invention is applicable to most of them and is not confined solely to the roller blind shown. For example endless loop controls are used in Venetian blinds and in vertical blinds, and in Russians, and balloons, to name only some of the more popular types of blinds and window coverings.

The blind control element, in other cases, may be a continuous length of cord, driving the blind through a different form of a drive mechanism (not shown) well known in the art.

The invention is equally applicable to a variety of forms of a blind control element, other than those described. Chains of various constructions, and drive belts, and drive cords, for example, also use the endless loop form of element control.

As explained the endless loop type of blind control element has been in use for very many years.

Building requirements are constantly being reviewed both by governmental building authorities, and the industry both to reduce hazards, and to eliminate accidents to children in particular.

It is now proposed that the loop type of blind control element shall not only be held in tension, but also that the loop of the blind control element shall be enclosed along its length, from the blind, at its upper extremity, down to its lower extremity.

This feature will greatly improve both convenience and safety since a child cannot become entangled in it, but it does pose some problems in execution.

The enclosing of the element should not make it more difficult to access the element for operation of the blind.

On the contrary, it should preferably make the element somewhat easier to operate, by preventing the element from becoming twisted or entangled with itself, or any other blind operating elements, which may be part of a more complex blind system (not shown), such as, for example, a vertical panel blind system, or a Venetian blind system.

Figure 5:
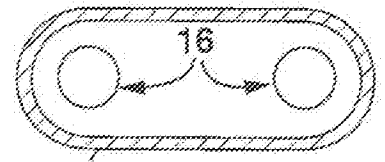
FIG. 5 is a section of the tubular form of enclosure.
Figure 6:
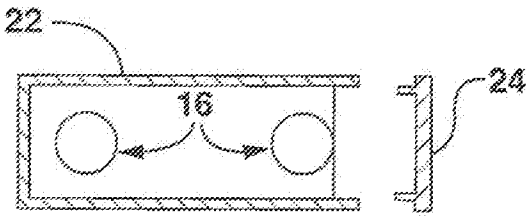
FIG. 6 is a section of a channel form of the enclosure.

For this purpose the invention, in this embodiment, provides a safety device or tubular enclosure 20 (FIGS. 1, 5 and 6) through which the blind control element 16 passes. The tube may be a complete tube, typically of extruded thermoplastic, or any other suitable material, such as aluminum, (FIG. 5), or it may be in the form of a channel or channels, such as a three-side channel 22 (FIG. 6), having a separate closure strip 24, which can be snap fitted, by friction into the open side of the channel 22.

The enclosure can be made in two or more sections. In one embodiment (FIG. 16) the sections are telescopic and thus avoid cutting the sections to length. In other embodiments the sections can be connected by connector or connecting member 120, or other connector means as shown in FIG. 9*a* or 17 for example. This makes if easy for customers to "build" or order from the manufacturer the safety device 20 to any length if for example they have a ten foot high window by adding several lengths of sections with the appropriate connectors.

Figure 2:
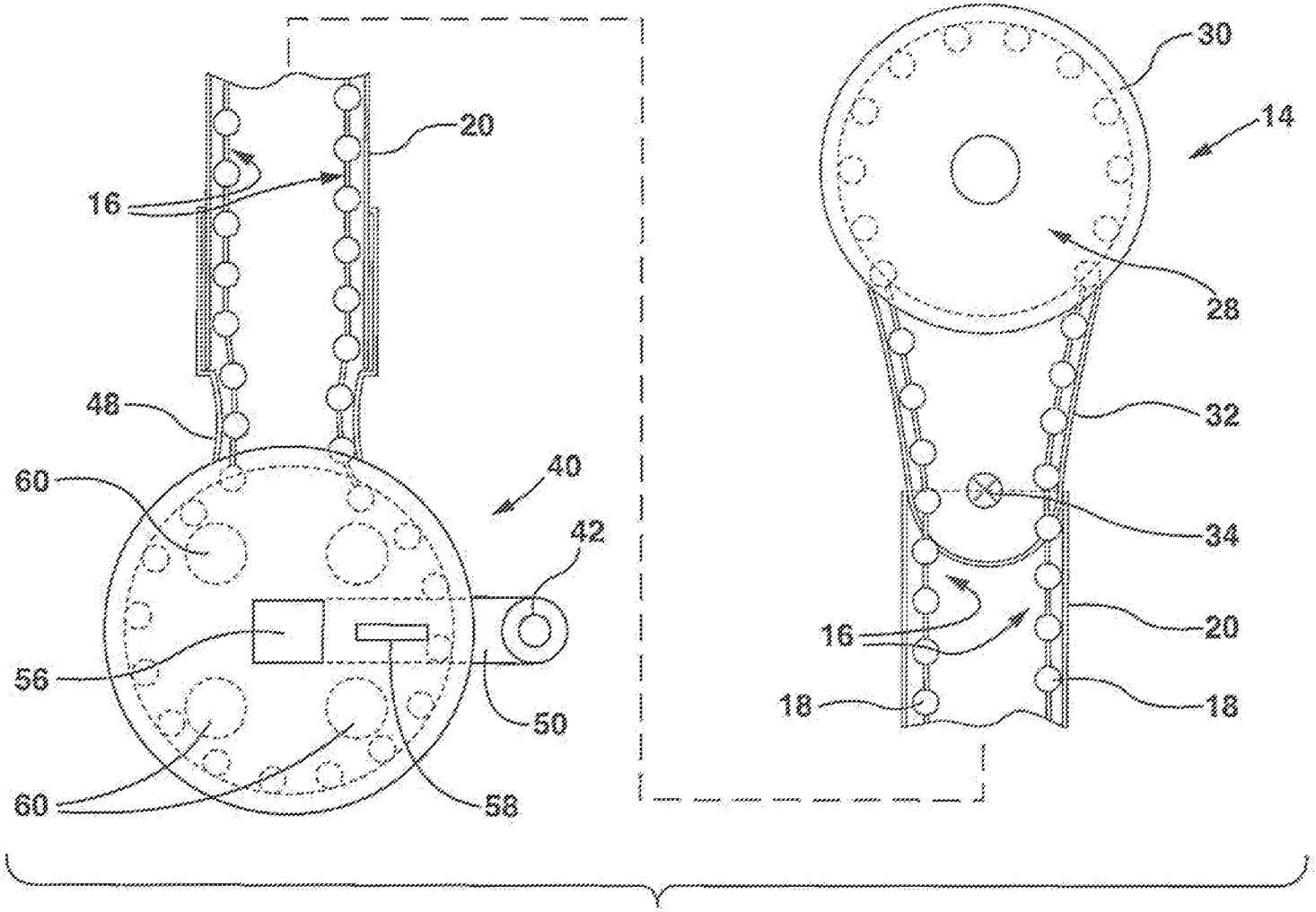
FIG. 2 is an exploded elevation view of the safety blind control element enclosure and operating device.

As is usual in this type of blind 14, a blind sprocket 28 is located at one end of the blind itself, in a housing 30. In this case the housing has a downwardly directed neck 32, curved and contoured to ensure smooth guided movement of the element 16 from the sprocket 28, into the safety device or enclosure 20. Usually the sprocket 28 or other control is coupled with some form of clutch (not shown) or brake system, which holds the blind in a desired position, and prevents the blind from unwinding due to gravity. The neck 32 is curved and contoured to present converging sides as shown in FIG. 2 thereby presenting a more compact device in profile.

The upper end of the safety device enclosure 20 is attached in this example by a fastener 34. The fastener 34 holds the end of the safety device or enclosure 20 to the neck of the housing 30 but permits the safety device or enclosure 20 to be swung away from the window as the enclosure 20 is fastened to the inside surface of the frame 12 by fastened 34. This provides a degree of convenience to the customer which might not have been available in previous forms of pulley systems for the element 16.

At the lower end of the safety device or enclosure 20 there is a drive device, 40 for operating the element 16.

The drive device 40 is shown as having features capable of engaging the element 16, typically being a somewhat larger diameter sprocket in this example the device 40 is another sprocket, suitable for rotatably driving the chain type of element 16 shown. Other forms of an engagement feature are possible for different forms of a control element. The drive device 40 in this case, is provided with a winding knob 42. This knob can be attached on either the right side or the left side of the drive device, depending on the location of the blind, and the preferences of the customer.

A housing 46 with suitable guide walls 48 is provided to guide the element 16 freely from the enclosure 20 onto the drive device 40. The housing would be made in two parts, so that the element can be fitted around the sprocket, and then secured by attaching the housing parts together.

Figure 7:
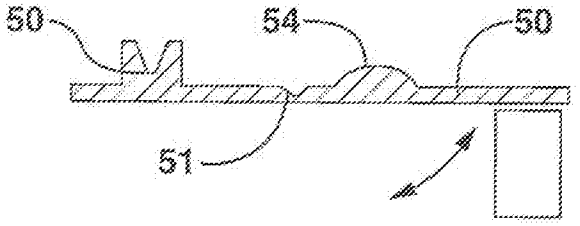
FIG. 7 is a schematic side elevation of one form of winding handle.

Numerous refinements can be added. For example, the knob 42 may be mounted on a radial arm 50 extending away from the drive device, to provide somewhat greater mechanical advantage for the customer. The arm could be hinged at 51 so as to be stowable onto the drive drum, when not in use (FIG. 7).

The arm 50 has a central hub body 52 and an abutment 54 engageable in suitable recesses 56 and 58 in the drive device, (FIG. 2).

The drive device 40 can also be provided with finger recesses or even holes 60, for operation by the fingers, or a suitable simple tool, even a pencil, for example.

Figure 3:
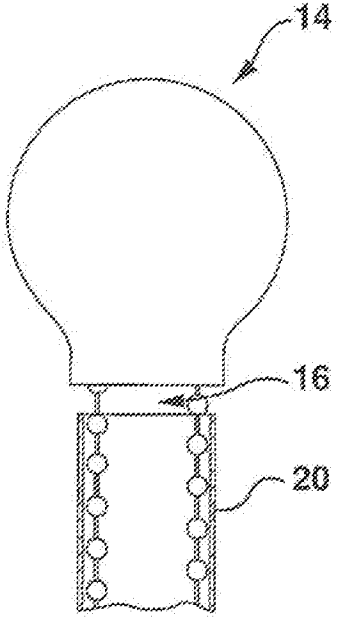
FIG. 3 is a schematic elevation of the upper end of the enclosure, showing one form of attachment.

Depending on customer preferences, the upper end of the enclosure 20 can possibly be left free of attachment to the blind (FIG. 3 and FIG. 4—showing different spacing from the blind 14), so that it hangs down supported only by the chain element 16.

Figure 4:
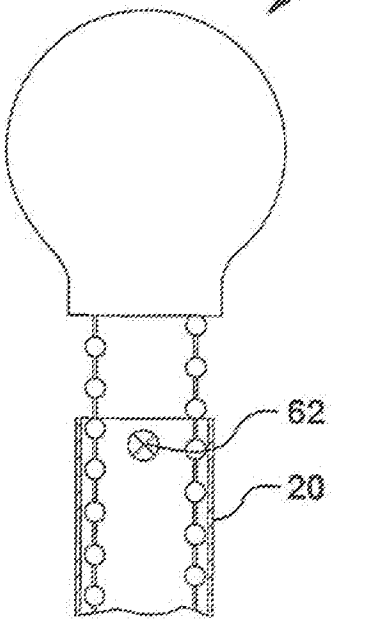
FIG. 4 is a schematic elevation of the upper end of the enclosure, showing another form of attachment.

Alternatively the upper end of the enclosure 20 can be left somewhat short of the blind itself, and can simply be attached to the window frame 12 by a screw 62 (FIG. 4). Such a screw fastening could also be provided at various positions along the length of the enclosure.

The safety device or enclosure 20 may be one piece from end to end, or, if desired, it may be made in two or even more, parts connected as at 64 (FIG. 1) or telescopic as shown and in more detail in FIG. 11 or 16 so as to be adjustable, for various different applications.

In another embodiment shown in FIG. 11 the wand 70 comprises two sliding sleeves 92 and 93. The sleeves provide a sliding telescopic joint.

This may assist a purchaser who wishes to purchase just the safety device or enclosure 20 and a drive device 40, and retro fit it to an existing old technology blind having the usual form of dangling endless loop control.

It is also possible to provide a small drive motor 67, FIG. 13. The drive motor includes having a male extension 72 that fits into a corresponding female socket 56, operated by a battery, so that moving the blind control element 16 can be done at the push of a button, or even by means of a remote (not shown).

Other embodiment are shown in FIGS. 8*a*, 8*b*, 8*c*, 8*d*, 8*e*, 8*f*, 9*a*, 9*b*, 9*c*, 10, 11, and 12.

FIGS. 8*a*, 8*b*, 8*c*, 8*d*, 8*e*, 8*f*, and FIG. 12 show an embodiment where the safety device or enclosure 20 is in the form of a flattened wand 70, see also FIGS. 10, 11, 12, and 20*a*, 20*b*, 20*c*, 20*d*. As best seen in FIG. 12 the wand 70 generally has an "H" shaped cross section, having on either side edge respective restricted open channels 72 and 72 defined by side walls 73, 75, and 77. These channel side walls 73 and 75 are shaped with shallow concave curvature 79 as shown, to receive the element 16 and restrict, block, shield or partially enclose and hold the element 16 in place. The size or diameter of the "balls" of the element closely approximate the distance between the walls 73 and 75 so that the element 16 snugly fits within the recess or channels 72. In another embodiment the size or diameter of the "balls" of the element 16 closely approximate the distance between the shallow concave curvatures 73 and 75 so that the element 16 easily fits info the cannels but bars access to, or inhibits the removal of the elements. Other types of elements such as rope, wire can be used with suitable adjustment to the spacing of the channels in accordance with the teachings of the invention herein. The size or diameter of the balls in element 16 are smaller than the depth of the walls 73 and 75 so as to make it difficult for a child to pry out of the element from the enclosure.

The wand 70 is comprised of a first of upper wand section 71 and a second or lower wand section 73 connected by a connector body 100.

Body 100 has upper and lower rods, extensions, or struts 124 extending from the connector body 100 into the tubes 74 of the upper 71 and lower 73 portions of the and 70. In this way rods, extensions or struts 124 act as a form of splint holding all three components together. The connector body 100 is formed at each end with shoulders 104 mating with the lateral sides 103, 105 of the channels 72 on opposite side edges of the wand 70.

Figure 8A:
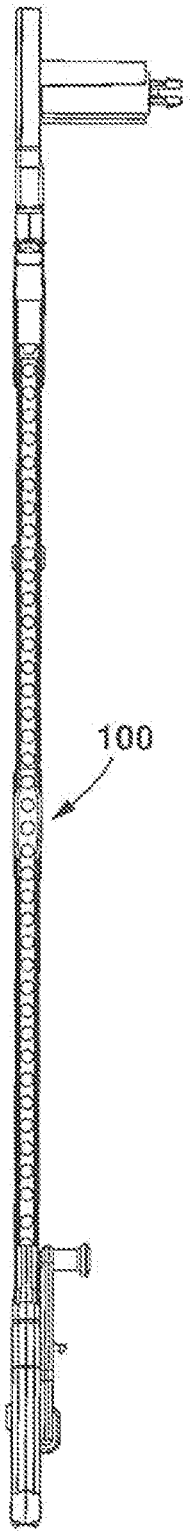
Figure 8B:
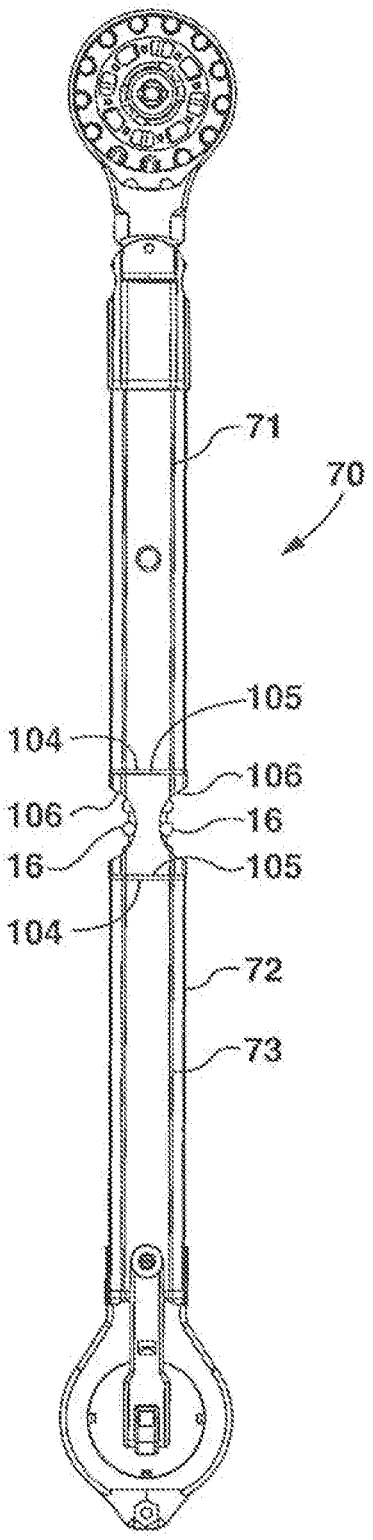
Figure 8C:
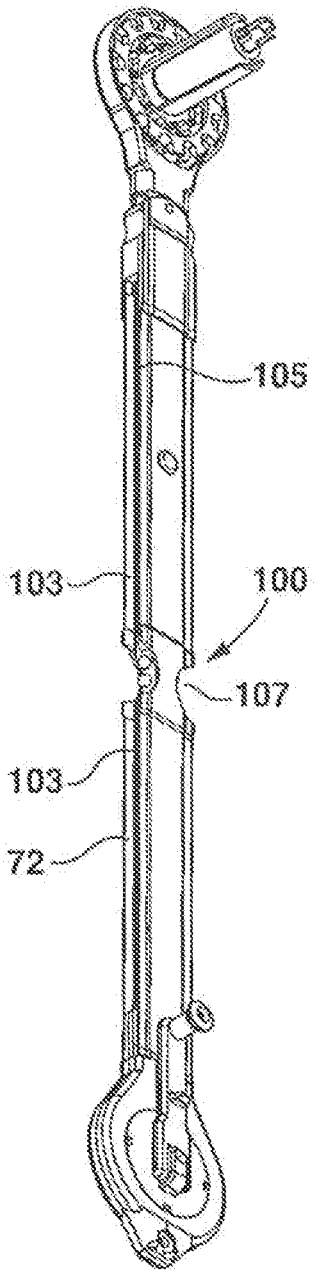
Figure 8D:
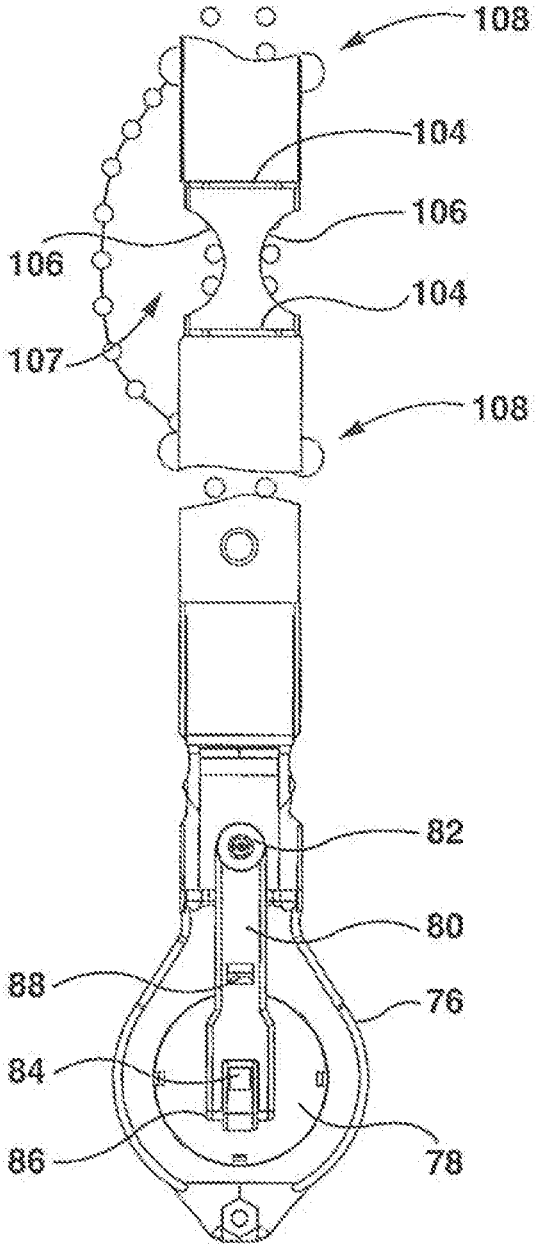
Figure 8E:
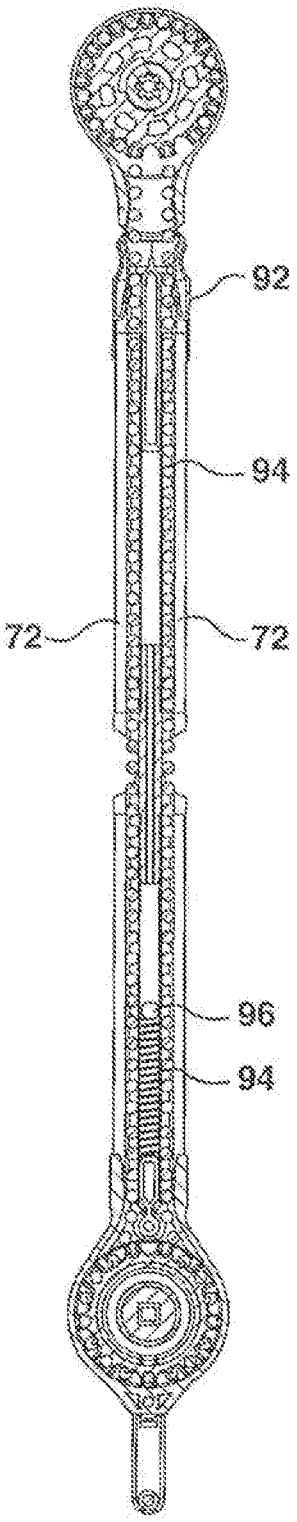
Figure 8F:
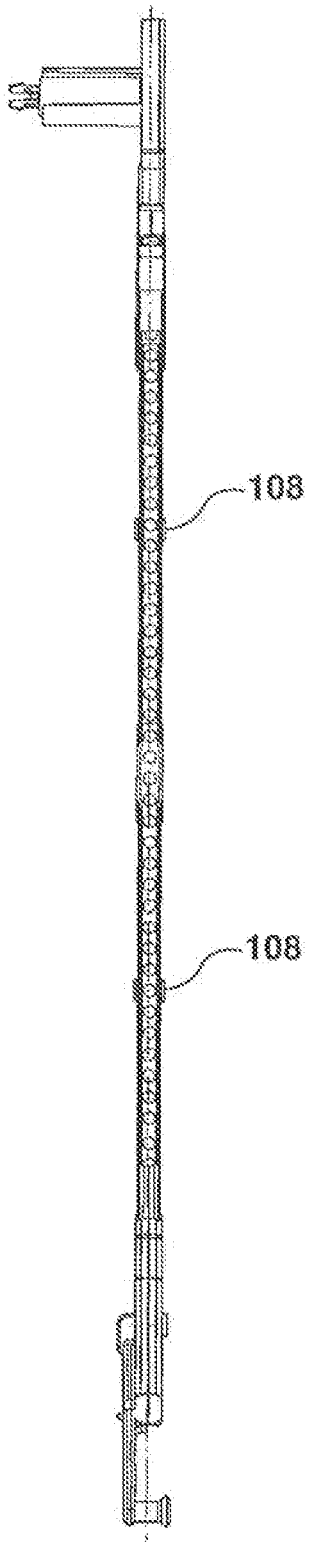

Stop members 108 can be secured in the channels 72 (FIGS. 8*a*, 8*d* and 24). These will have the effect of limiting the length of the chain or element 16 that can be pulled out from one or other channel 72. This will still further enhance the overall safety of the product.

The stop members 108 may be slideably adjustable along each channel, by sliding along the length of the channel 72 to a selected position and can be secured by clamping screws 111 or any number of other fasteners including adhesives or snapping the parts together.

Between the upper and lower shoulders 104 there are recesses 106 of generally semi-arcuate concave shape. These recesses expose the element 16 along a short length on either side edge 107 of the connector body 100. The recesses 106 provide access for adults to action the element 16 to operate the blind in the traditional way. The finger access 106 is high enough from the floor out of reach from children. In other words another embodiment consists of eliminating the drive 40 and just using the linger access 106; or having a choice of selectively using the finger access or driver 40.

This is to enable a person to grasp the element 16 with finger and thumb, within such recesses 106 and to manually adjust the element 16 one way or the other, for moving the blind.

In another embodiment the finger access 106 could be formed in the side of a one piece wand 70.

While doing this the safety device or element 18 will have to be pulled slightly away from the side edge 107 or edges of the wand 70, FIG. 8*d*. This will result in the wand 70 becoming in effect slightly shorter with the wand sliding into a sleeve 92, compressing spring 94.

When released the wand will slide partially out of the sleeve 92. The element 16 will then be drawn back into the channels of the wand 70.

In this way, it is possible for the homeowner to make simple manual adjustments, by grasping and moving the element with the fingers, without leaving a hanging loop of the element 16 free to create possible hazards.

Stop members 108 can be secured in the channels 72 (FIG. 8*a*, 9*d*). These will have the effect of limiting the length of the chain or element 18 that can be pulled out from one or other channel. This will still further enhance the overall safely of the product. Although four stop members 108 are shown, any number can be used within the scope of this invention.

The stop members may be adjustable along each channel, by sliding along the length of the channel 72 to a selected position and can be secured by clamping screws.

The interior of a wand 70 defines an internal rectangular tube 74 (FIG. 12). At the lower end of the wand 70 a housing 76 (FIG. 8*d*) encloses the drive member 78 for driving the element 16.

This drive member 78, in this case, has a winding arm 80 and knob 82. The arm 80 is attached to an axle 84 driving the drive member 78.

The arm can be swung, by joint 86 to lie flat against the housing. A lock member 88 holds the arm in this position when not in use.

The axle 84 preferably has a keyed opening a female socket 56, in this case being simply square.

A suitable hand held appliance 67, i.e. an electric motor appliance, powered by a battery (FIG. 13) with a suitable keyed drive tool 72 which can be inserted in the keyed opening 84 and power operated, to raise or lower the blind.

Within the rectangular tube 74 of the wand 70 there is a spring 94 with one end resting on a support surface or button 96 (FIG. 10) The other end of the spring 94 engages an end of a rod 98 inside the tube 74. The rod 98 in this case is moulded as part of the sleeve 92. The effect of the spring 94 is to urge the wand 70 out of the sleeve 92 so as to keep the element 16 taught. The sleeve 92 and spring 54 spring are in one embodiment located between the lower end on the wand 70 and the drive device housing 76. However in other embodiments the spring could be located in the middle or tor top end of the wand in accordance with the invention described.

The side view of the embodiment shown in FIG. 8*a* shows the safety shape of the H channel that conceals the chain or chord 16 on a safe way not generally accessible to children. It should be noted that other cross sectional shapes can be used in other embodiments of the invention.

In some cases it may be preferable to locate the sleeve and spring between two sections 71 and 73 of the wand.

In another embodiment shown in FIGS. 9*a*, 9*b*, and 9*e*, the wand 70 is in two parte, upper part 71 and lower part 73. Between the two parts there is a connector body 120 (and FIG. 14).

Connector body 120 has upper end lower struts 124 extending from the connector body 120 into the tubes 74 of the upper 71 and lower 73 portions of the wand 70. In this way the struts 124 act as a form of splint holding all three components together. The connector body 120 is formed at each end with shoulders 104 mating with the lateral sides 103, 105 of the channels 72 on opposite side edges of the wand 70.

Stop members 108 can be secured in the channels 72 (FIGS. 8*a*, 9*a*, and 24). These will have the effect of limiting the length of the chain or element 16 that can be pulled out from one or other channel 72. This will still further enhance the overall safety of the product.

The stop members 108 may be sildably adjustable along each channel 72, by sliding along the length of the channel 72 to a selected position and can be secured by clamping screws 111.

If a motor drive appliance is required, it could be made as shown in FIG. 13. This would have the proportions of a simple flashlight. There would be a housing containing one or more batteries (not shown). A switch 65 would enable if to be switched on and off. A motor in the housing (not shown) would be driven by the batteries.

A drive tool 72 would extend from one end of the motor drive 67. The tool 72 would have a keyed shape, corresponding the key way shape of the recess 56 in the axle 84.

When required the homeowner would simply insert the tool 72 into the key way in the axle 84 and operate the motor.

In yet another embodiment one could eliminate the connector body 120 and use a one piece wand 70 and form a hole transversely through the wall of the wand 70 so as to attach a cam 123. In yet another embodiment one can eliminate the driver 40 and just use the handle 128 and cam 123, or having a choice of selectively using the handle 128 and cam 123 or driver 40.

In another embodiment the safety device or he wand 70 can be made in two or more lengths, one being slightly larger than the other, to enable the two lengths to be telescoped together FIG. 11 or 16. As explained this feature may be useful where a homeowner wishes to retrofit the system onto an existing blind with old technology dangling loop elements.

In order to promote such retrofitting, and improve home safety, the invention also provides an adapter collar 112 (FIG. 15).

This collar is intended to be attached directly onto the sprocket housing 30 of an existing old technology blind. The collar 112 may be secured to the sprocket housing 30 by for example a screw 113 or adhesive or other fastening means. The interior of the collar 112 has guide surfaces, guiding the element 16 from the sprocket down into the safety device or enclosure which may either be the wand 70, or tube 20.

The homeowner can then simply take the safety device or enclosure 20, 70 and slide the element loop 16 down through the enclosure 20. The drive device at the lower end of the element is provided with a housing in two parts, or a housing door which can be opened, to fit the element loop around the sprocket or other drive member. The housing would then be closed.

A further embodiment is shown in FIG. 17. In this case there is an element guide body 114, separate from the wand 70. The element guide body 114 would be attached to the window frame, or wall, by for example a screw 116 with a wall plug 117, and spacers 119, if required, so as to maintain the body aligned in the path of the element 16.

Element guide body 114 has guide surfaces providing a smooth path for the element from the blind sprocket into the wand 70.

In another embodiment as best shown in FIGS. 9*a* and 14 there is a sliding coupling or connecting member 120 and spring 94 connected between upper and lower wand sections 71 and 73. Between the two sections 71 and 73 there is a connecting member 120, having two rods 124 (FIG. 9*a*, 17) which extend into the central tubes of the two enclosure sections. Connecting member 120 is of generally H-shaped cross section defining channels 72, on opposite sides, for receiving the element 16.

Connecting member 120 is hollow and contains a cam 123, similar to FIG. 14. The cam 123 may be manually swung to one side or the other, by an exterior lever or handle 128. Swinging of the handle 120 will project the cam 123 end element 16 on one side or the other of the member 120. This will enable the user to grasp the element and move it, thus adjusting the blind with the fingers.

In doing so the enclosure will be forced against the spring 94. When the element is released, the spring will extend the enclosure away from the member 122 and tension the element back into the channel 72 away from the reach of children.

Other embodiments are shown in FIGS. 18 and 19. In this case the blind sprocket 130 is driven by a short loop 132 of the element 16. Short loop 132 extends down and passes into a gear body 134. Gear body 134 had an integral rod 136 extending down into the tube 74 of the wand 70.

Within gear body 134 the short loop 132 passes around a first drive gear 142 rotatably mounted in body 134.

Gear body 134 hangs down on a short loop 132. It is not secured to any wall or window frame. A second drive gear 144 is also rotatably mounted in gear body 134, and meshes with first drive gear 142.

The wand 70 is separate from gear body 134 and contains a long loop 168 of the element 16. Long loop 168 extends up out of the top end of the wand 70 and passes info gear body 134 around second drive gear 144. At the lower end of wand 70 the long loop passes around a drive system already described above.

Movement of the long loop 168 caused by the drive 40, 76 (or simply by the fingers engaging holes 60 as previously discussed) will rotate second gear 144. This in turn will rotate first gear 142, thus moving the short loop 132.

In the embodiment shown in FIG. 9*a* the wand 70 is formed in two sections 71 and 73, joined by a connector body member 120, having rods 124 extending into the two sections of the wand 70. The connector body 120 has side channels (described above) for the element 16.

A cam mounted within connector body 122 can be swung right or left, by a lever 152 Swinging of the cam will push a portion of the long loop 168 out of the body 146 on one side or the other. The operator can then grasp the element in the fingers and move it by hand, if he wishes, to adjust the blind. In doing so he will, in effect, shorten the long loop 16. This will force the wand 70 to move compressing the spring 149.

Once one releases the element 16, the spring 94 will extend the safety device or enclosure 20 and the element 16 will be retracted back into the channel 72 in the connector body 120.

It will be seen that with this embodiment the gear body 134 is not secured to the window frame 12, or to the wall of the building. This will reduce the chance that the wand 70 and the element 16 may be rendered unserviceable, due perhaps to the loosening of the fastening.

Further embodiments of the enclosure is shown in FIGS. 20*a*, 20*b*, 20*c*, and 20*d*.

In FIG. 20*a* the enclosure 160 has one side edge 162 of the enclosure almost closed, except for a small slot 164 where the wire portion of the element 16 can be inserted.

The other side edge of the enclosure is a restricted channel 166, with shallow concave restrictions.

Within the enclosure there are two transverse walls 168, separating the two lengths of the element from each other.

In FIG. 20*b* the enclosure has one side edge 163 completely closed at 170 and the other side edge a restricted channel 172. In this case there are two pairs of partial interior walls 174 and 176. The two pairs define between them small gaps. These gaps enable the passage of the wire portions of the elements to be passed down for threading the element loop into the enclosure.

In FIG. 20*c* the one side edge has an almost closed tube 178 with a small slot 180. The other side edge has a restricted channel 182 with restricted side walls.

In FIG. 20*d* the enclosure has two closed tubes 184 and 186. Two pairs of interior partial transverse wall 188 and 190 each define small gaps between them. These gaps permit the passage of the wires, between the balls on a chain element to be slid between them. This enables a loop of an element 16 to be introduced through the enclosure from one end to the other.

FIG. 21 shows another embodiment of the invention where the wand 71 & 73 pivots about axis 33 (screw 34)

FIG. 22 is similar to FIG. 21 except the wand 70 in FIG. 22 pivots or rotates about axis 33 defined by a screw 34 BUT also pivots about the two projections 35 that define a second axis 35-35 (i.e. the bottom part pivots out of the page).

Swinging connector 31 comprises first swinging connector 39 which is secured to the sprocket housing 30 by means of a fastener 43. The first swinging connector 39 has two arms 45 having aligned holes 41 defining the axis 35-35. The second swing connector 37 has a depending portion 47 that is attached to the upper part of the enclosure 20 by a fastener 23. The second swing connector 37 includes two projections 35 that are journaled for rotation within holes 41. The swing connector 31 allows the device to pivot about an axis defined by screw 43 so as to pivot about a first axis and also to pivot about a second axis defined by 35-35.

FIG. 23 is a partial exploded view of another embodiment showing slideable stoppers;

FIG. 24 shows one embodiment of the stoppers 108. The stopper 108 has an upper section that fits over the recess 72 and a lower section 200 that fits in the recess 72 that Is fastened together by a screw 111. The lower section 200 is concave in cross section 201 and convex 204 along the length so as to provide a smooth surface to the element 16 to slide against.

FIG. 26 shows a further embodiment of invention where the gear box 134 (shown in FIG. 18) comprises two spaced gear boxes 134*a* and 134*b* and the two spaced gear boxes 134*a* and 134*b* are connected at protruding shafts 133 and 135 by a linking means such as a link 137.

The invention is not to be taken as limited to any of the specific features as described, but comprehends all such variations thereof as come within the scope of the appended claims.

What is claimed is:

1. A blind having a blind operating mechanism and an endless loop blind control element for operating the blind operating mechanism and comprising:

(a) an enclosure extending from an upper end to a lower end;

(b) a connector supporting the upper end of the enclosure adjacent to the blind operating mechanism and depending downwardly from the blind operating mechanism; and, (c) a rotatable drive on the lower end of the enclosure connecting with the endless loop blind control element for operating the endless loop blind control element within the enclosure upon rotation of the rotatable drive;

and wherein the endless loop blind control element defines two loop portions and wherein the enclosure is in the form of an elongated flattened wand defining an interior tube and two edges and including a first channel extending from said upper end to the lower end for one loop portion of the element formed along one edge of the wand and a second channel extending from said upper end to the lower end for the other loop portion of the element formed along the other edge of the wand.

2. The blind as claimed in claim 1 wherein the wand is in two sections and each said wand sections include a portion of said two edges, including a connector body between the two wand sections, said connector body having two connector body edges; where each said portion of said two edges of said wand sections and said two connector body edges define said two edges.

3. A blind having a blind operating mechanism and an endless loop blind control element for operating the blind operating mechanism and comprising:

(a) an enclosure extending from an upper end to a lower end;

(b) a connector supporting the upper end of the enclosure adjacent to the blind operating mechanism and depending downwardly from the blind operating mechanism; and, (c) a rotatable drive on the lower end of the enclosure connecting with the endless loop blind control element for operating the endless loop blind control element within the enclosure upon rotation of the rotatable drive;

and wherein the endless loop blind control element defines two loop portions and wherein the enclosure is in the form of an elongated flattened wand defining two edges and including a first channel extending from said upper end to the lower end for one loop portion of the element formed along one edge of the wand and a second channel extending from said upper end to the lower end for the other loop portion of the element formed along the other edge of the wand;

and wherein the wand is in two sections and including a connector body between the two sections;

and wherein the two wand sections each define interior tubes and including two rods formed integrally with said connector body, with one rod received in the tube of one of said wand sections, and the other said rod received in the tube of the other said wand section.

4. The blind as claimed in claim 3 wherein the connector body defines grooves on opposite sides of said connector body, aligned with the first and second channels in said two wand sections respectively, for receiving said endless loop blind control element therein.

5. The blind as claimed in claim 4 and including concave depressions formed in said grooves of said connector body to access the endless loop blind control element in said concave depressions.

6. The blind as claimed in claim 4 and including at least one pair of spaced apart selectively moveable stop members secured in at least one of said channels controlling the withdrawal of said element from said at least one of said first and second channels between said at least one pair of spaced apart stop members.

7. The blind control element as claimed in claim 3 wherein at least one of said first and second channels has opposite side walls and including shallow curved formations formed in said at least one of said first and second channel walls for retaining said endless loop blind control element therein.

8. The blind as claimed in claim 3 further including a biasing means for urging said upper end and lower end apart, and wherein said biasing means is compressible for moving said upper and lower ends towards one another.

9. A blind having a blind operating mechanism and an endless loop blind control element for operating the blind operating mechanism and comprising;

(a) an enclosure extending from an upper end to a lower end, with the endless loop blind control element enclosed within the enclosure between the upper end to the lower end of said enclosure;

(b) a connector supporting the upper end of the enclosure adjacent to the blind operating mechanism and depending downwardly from the blind operating mechanism; and, (c) a rotatable drive device on the lower end of the enclosure connecting with the endless loop blind control element for operating the endless loop blind control element within the enclosure upon rotation of the drive device;

wherein said enclosure comprises an elongated body along its length and defining, along one side a tube, and along the other side a channel with side walls defining shallow concave formations.

10. A blind having a blind operating mechanism and an endless loop blind control element for operating the blind operating mechanism and comprising;

(a) an enclosure extending from an upper end to a lower end, with the endless loop blind control element enclosed within the enclosure between the upper end to the lower end of said enclosure;

(b) a connector supporting the upper end of the enclosure adjacent to the blind operating mechanism and depending downwardly from the blind operating mechanism; and, (c) a rotatable drive device on the lower end of the enclosure connecting with the endless loop blind control element for operating the endless loop blind control element within the enclosure upon rotation of the drive device;

wherein said enclosure comprises an elongated body along its length and defining, along one side a first tube, and a second tube along its other side, and including two pairs of spaced apart partition walls within said enclosure and extending between said first and second tubes and wherein said partition walls define spaces there between for passage of portions of said endless loop blind control element there between.

11. A blind having a blind operating mechanism and an endless loop blind control element for operating the blind operating mechanism and comprising;

(a) an enclosure extending from an upper end to a lower end, with the endless loop blind control element enclosed within the enclosure between the upper end to the lower end of said enclosure;

(b) a connector supporting the upper end of the enclosure adjacent to the blind operating mechanism and depending downwardly from the blind operating mechanism; and, (c) a rotatable drive device on the lower end of the enclosure connecting with the endless loop blind control element and operating the endless loop blind control element within the enclosure upon rotation of the drive device;

and including a telescopic joint formed between said enclosure and said drive device, and a spring biasing said joint apart and said enclosure being slidable into said joint to compress said spring.

12. A safety device for an endless loop blind control element operating a blind operating mechanism, the safety device comprising;

(a) an enclosure extending from an upper end to a lower end, the enclosure for the endless loop blind control element, the enclosure having an interior tube and at least one channel extending from the upper end to the lower end to receive and inhibit access to the endless loop blind control element; said at least one channel having a concave opening to limit access to, and manipulation of the endless loop blind control element;

(b) biasing means disposed in the enclosure to urge opposite ends of the endless loop blind control element away from each other;

(c) a rotatable drive device carried by the enclosure connecting the endless loop blind control element to the blind operating mechanism.

13. The safety device as claimed in claim 12 wherein said at least one channel is disposed on an external surface of the enclosure for receiving and inhibiting access to a portion of the endless loop blind control element.

14. The safety device as claimed in claim 13 comprising a second channel disposed on the external surface of the enclosure, said second channel spaced from said first channel, each said first and second spaced apart channels receiving and inhibiting access to a portion of the endless loop blind control element respectively; each said first and second spaced apart channels having a curved opening to restrict access to manipulate the endless loop blind control.

15. The safety device as claimed in claim 14 wherein the upper end is pivotally connected to the blind operating mechanism for movement of the enclosure relative to the blind operating mechanism about a first axis.

16. The safety device as claimed in claim 15 wherein the upper end is pivotally connected to the blind operating mechanism for movement of the enclosure relative the operating mechanism about a second axis substantially perpendicular to the first axis.

17. The safety device as claimed in claim 14 wherein said first and second channels include two spaced side walls extending outwardly to define two spaced surfaces curved toward each other for narrowing the spacing between the two spaced side walls for restricting access to the endless loop blind control element.

18. The safety device as claimed in claim 14 wherein at least one of said channels include one or more selectively moveable safety adjustment limiters secured to said one of said channels to control the withdrawal of said endless loop blind control element away from said at least one of said channels.

19. The safety device as claimed in claim 14 wherein at least one of said channels includes a pair of selectively moveable safety adjustment limiters secured to said at least one channel to adjust the distance between the pair of safety adjustment limiters to control the withdrawal of said endless loop blind control element from the said at least one channel between the pair of said safety adjustment limiters.

20. A blind as claimed in claim 4 having a blind operating mechanism and an endless loop blind control element for operating the blind mechanism as claimed in claim 4 wherein said connector body is "H-shaped" in section.

21. A safety device for an endless loop blind control element operating a blind operating mechanism comprising;

(a) an enclosure for the endless loop blind control element, the enclosure having at least one channel for receiving and inhibiting access to the endless loop blind control element; said at least one channel defined by two spaced walls extending outwardly from said enclosure to define two spaced channel surfaces each having flat portions extending outwardly to a curved portion which curve toward each other so as to receive said endless loop blind control element between said flat portions of said spaced channel surfaces, and where said curved portions of said spaced channel surfaces form a restriction in said channel for restricting access to the endless loop blind control element;

(b) biasing means disposed in the enclosure for urging opposite ends of the endless loop blind control element away from each other;

(c) a drive device carried by the enclosure connecting the endless loop blind control element to the blind operating mechanism.

22. The safety device as claimed in claim 21 wherein said biasing means is also compressible to move said opposite ends together.

* * * * *